US006701637B2

(12) United States Patent
Lindsay et al.

(10) Patent No.: US 6,701,637 B2
(45) Date of Patent: Mar. 9, 2004

(54) SYSTEMS FOR TISSUE DRIED WITH METAL BANDS

(75) Inventors: Jeffrey Dean Lindsay, Appleton, WI (US); Kenneth Curtis Larson, Appleton, WI (US); Charles Herbert Goerg, Appleton, WI (US); Timothy Maurice McFarland, Neenah, WI (US); Michael Alan Hermans, Neenah, WI (US); Paul Douglas Beuther, Neenah, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 281 days.

(21) Appl. No.: 09/839,875

(22) Filed: Apr. 20, 2001

(65) Prior Publication Data

US 2002/0152630 A1 Oct. 24, 2002

(51) Int. Cl.[7] ..... F26B 19/00

(52) U.S. Cl. ..... 34/71; 34/95; 34/111; 34/123; 34/627; 34/635; 162/206; 162/207

(58) Field of Search ..... 34/71, 95, 111, 34/123, 620, 623, 627, 635; 162/109, 111, 112, 113, 117, 205, 206, 207

(56) References Cited

U.S. PATENT DOCUMENTS

| | | | |
|---|---|---|---|
| 3,225,074 | A | 12/1965 | Cowen et al. |
| 3,301,746 | A | 1/1967 | Sanford et al. |
| 3,473,576 | A | 10/1969 | Amneus |
| 3,556,932 | A | 1/1971 | Coscia et al. |
| 3,556,933 | A | 1/1971 | Williams et al. |
| 3,573,164 | A | 3/1971 | Friedberg et al. |
| 3,585,104 | A | 6/1971 | Kleinert |
| 3,700,623 | A | 10/1972 | Keim |
| 3,772,076 | A | 11/1973 | Keim |
| 3,821,068 | A | 6/1974 | Shaw |
| 3,825,381 | A | 7/1974 | Dunning et al. |
| 3,879,257 | A | 4/1975 | Gentile et al. |
| 3,885,158 | A | 5/1975 | Flutie et al. |
| 3,886,036 | A | 5/1975 | Dahlin |
| 3,899,388 | A | 8/1975 | Petrovich et al. |
| 3,905,863 | A | 9/1975 | Ayers |
| 3,923,593 | A | 12/1975 | Verseput |
| 3,925,906 | A | 12/1975 | Chance et al. |
| 3,972,855 | A | 8/1976 | Martinsson et al. |
| 3,974,025 | A | 8/1976 | Ayers |
| 4,003,783 | A | 1/1977 | Groome et al. |
| 4,070,238 | A | 1/1978 | Wahren |
| 4,100,324 | A | 7/1978 | Anderson et al. |
| 4,112,586 | A | 9/1978 | Lehtinen |
| 4,129,528 | A | 12/1978 | Petrovich et al. |

(List continued on next page.)

FOREIGN PATENT DOCUMENTS

| | | |
|---|---|---|
| EP | 0 101 202 A2 | 2/1984 |
| EP | 0 349 202 B1 | 1/1990 |
| EP | 0 478 525 B1 | 4/1992 |

(List continued on next page.)

OTHER PUBLICATIONS

Di Ruscio, Mike, "Spiral Fabrics as Dryer Fabrics," *Paper-Age*, Jan. 2000, pp. 20–23.

(List continued on next page.)

*Primary Examiner*—Jiping Lu
(74) *Attorney, Agent, or Firm*—Patricia A. Charlier

(57) ABSTRACT

A web treatment device is disclosed capable of heating and creping a fibrous web with control systems for uniform operation. The web is pressed between two belts in a compression zone, where is it also subject to a temperature gradient that can assist in water removal. Durable coatings on the press belts can assist in maintaining good performance. The system can be used to apply texture to a fibrous web or drive chemical reactions or other physical changes in the web.

66 Claims, 7 Drawing Sheets

U.S. PATENT DOCUMENTS 4,144,122 A 3/1979 Emanuelsson et al.
4,147,586 A 4/1979 Petrovich et al.
4,185,399 A 1/1980 Gladish
4,222,921 A 9/1980 Van Eenam
4,225,382 A 9/1980 Kearney et al.
4,239,065 A 12/1980 Trokhan
4,300,981 A 11/1981 Carstens
4,375,448 A 3/1983 Appel et al.
4,377,543 A 3/1983 Strohbeen et al.
4,420,370 A 12/1983 Saad
4,440,597 A 4/1984 Wells et al.
4,445,974 A 5/1984 Stenberg
4,461,095 A 7/1984 Lehtinen
4,494,278 A 1/1985 Kroyer et al.
4,506,456 A 3/1985 Lehtinen
4,506,457 A 3/1985 Lehtinen
4,514,345 A 4/1985 Johnson et al.
4,528,239 A 7/1985 Trokhan
4,529,480 A 7/1985 Trokhan
4,541,895 A 9/1985 Albert
4,556,450 A 12/1985 Chuang et al.
4,594,130 A 6/1986 Chang et al.
4,622,758 A 11/1986 Lehtinen et al.
4,626,476 A 12/1986 Londry et al.
4,631,837 A 12/1986 Magoon
4,637,859 A 1/1987 Trokhan
4,639,291 A 1/1987 Ota et al.
4,640,810 A 2/1987 Laursen et al.
4,671,173 A 6/1987 Boissevain
4,675,394 A 6/1987 Solarek et al.
4,683,092 A 7/1987 Tsang
4,701,857 A 10/1987 Robinson
4,738,752 A 4/1988 Busker et al.
4,758,310 A 7/1988 Miller
4,777,604 A 10/1988 Robinson
4,781,795 A 11/1988 Miller
4,787,641 A 11/1988 Rautakorpi et al.
4,793,898 A 12/1988 Laamanen et al.
4,823,477 A 4/1989 Soininen
4,849,054 A 7/1989 Klowak
4,879,170 A 11/1989 Radwanski et al.
4,887,362 A 12/1989 Rautakorpi
4,899,461 A 2/1990 Lehtinen
4,932,139 A 6/1990 Lehtinen
4,958,444 A 9/1990 Rautakorpi et al.
4,981,557 A 1/1991 Bjorkquist
5,008,344 A 4/1991 Bjorkquist
5,045,342 A 9/1991 Boissevain et al.
5,048,589 A 9/1991 Cook et al.
5,065,673 A 11/1991 Taylor et al.
5,073,235 A 12/1991 Trokhan
5,085,736 A 2/1992 Bjorkquist
5,098,522 A 3/1992 Smurkoski et al.
5,101,574 A 4/1992 Orloff et al.
5,215,626 A 6/1993 Ampulski et al.
5,232,555 A 8/1993 Daunais et al.
5,261,146 A 11/1993 Belliot
5,272,821 A 12/1993 Orloff et al.
5,276,978 A 1/1994 Hopkins et al.
5,334,289 A 8/1994 Trokhan et al.
5,350,624 A 9/1994 Georger et al.
5,353,521 A 10/1994 Orloff
5,377,428 A 1/1995 Clark
5,400,247 A 3/1995 He
5,403,446 A 4/1995 Trelsmo et al.
5,415,738 A 5/1995 Mehta et al.
5,417,810 A 5/1995 Morris
5,431,643 A 7/1995 Ouellette et al.
5,489,364 A 2/1996 Marinack
5,508,095 A 4/1996 Allum et al.
5,524,532 A 6/1996 Koivukunnas et al.
5,527,171 A 6/1996 Soerensen
5,566,472 A 10/1996 Lehtinen et al.
5,571,382 A 11/1996 Berglund
5,594,996 A 1/1997 Haavisto
5,594,997 A 1/1997 Lehtinen
5,595,628 A 1/1997 Gordon et al.
5,598,642 A 2/1997 Orloff et al.
5,598,643 A 2/1997 Chuang et al.
5,607,551 A 3/1997 Farrington, Jr. et al.
5,619,806 A 4/1997 Warren
5,656,132 A 8/1997 Farrington, Jr. et al.
5,667,636 A 9/1997 Engel et al.
5,667,641 A 9/1997 Poirier et al.
5,669,159 A 9/1997 Orloff et al.
5,674,361 A 10/1997 Marinack
5,679,222 A 10/1997 Rasch et al.
5,699,626 A 12/1997 Chuang et al.
5,701,682 A 12/1997 Chuang et al.
5,706,587 A 1/1998 Lehtinen et al.
5,746,009 A 5/1998 Brugger
5,769,832 A 6/1998 Hasse
5,772,845 A 6/1998 Farrington, Jr. et al.
5,778,555 A 7/1998 Lehtinen et al.
5,799,409 A 9/1998 Chau-Huu et al.
5,830,321 A 11/1998 Lindsay et al.
5,840,403 A 11/1998 Trokhan et al.
5,855,739 A 1/1999 Ampulski et al.
5,863,663 A 1/1999 Mackey et al.
5,878,506 A 3/1999 Rautakorpi
5,885,415 A 3/1999 Marinack et al.
5,891,309 A 4/1999 Page et al.
5,908,707 A 6/1999 Cabell et al.
5,914,177 A 6/1999 Smith, III et al.
5,915,813 A 6/1999 Joiner
5,922,335 A 7/1999 Ptchelintsev
5,928,475 A 7/1999 Chase et al.
5,932,068 A 8/1999 Farrington, Jr. et al.
5,935,381 A 8/1999 Trokhan et al.
5,935,383 A 8/1999 Sun et al.
5,938,893 A 8/1999 Trokhan et al.
5,944,958 A 8/1999 Svanqvist
5,958,178 A 9/1999 Bartsch et al.
5,958,558 A 9/1999 Giesfeldt et al.
5,990,377 A 11/1999 Chen et al.
5,993,602 A 11/1999 Smith et al.
6,001,381 A 12/1999 Gordon et al.
6,004,542 A 12/1999 O'Lenick, Jr.
6,004,543 A 12/1999 Galey
6,049,998 A 4/2000 Crouse et al.
6,066,390 A 5/2000 Quigley
6,076,275 A 6/2000 Kuno et al.
6,080,278 A 6/2000 Heaven et al.
6,080,691 A 6/2000 Lindsay et al.
6,104,987 A 8/2000 Farnsworth
6,139,686 A * 10/2000 Trokhan et al. ..... 162/109
6,187,137 B1 2/2001 Druecke et al.
6,228,216 B1 5/2001 Lindsay et al.

FOREIGN PATENT DOCUMENTS

EP 0 612 883 A1 8/1994
EP 0 858 838 A1 8/1998
FR 2 520 770 8/1983
WO WO 95/13780 A1 5/1995
WO WO 96/11300 A1 4/1996
WO WO 97/19223 A1 5/1997
WO WO 97/39185 A1 10/1997
WO WO 97/43483 A1 11/1997
WO WO 98/04220 A1 2/1998
WO WO 98/10142 A1 3/1998
WO WO 98/39515 A1 9/1998

| | | | |
|---|---|---|---|
| WO | WO 99/09248 | A1 | 2/1999 |
| WO | WO 99/23296 | A1 | 5/1999 |
| WO | WO 99/23298 | A1 | 5/1999 |
| WO | WO 99/23301 | A1 | 5/1999 |
| WO | WO 99/32716 | A1 | 7/1999 |
| WO | WO 99/34060 | A1 | 7/1999 |
| WO | WO 99/36620 | A1 | 7/1999 |
| WO | WO 00/03085 | A1 | 1/2000 |
| WO | WO 00/03092 | A1 | 1/2000 |
| WO | WO 00/09914 | A2 | 2/2000 |
| WO | WO 00/34572 | A1 | 6/2000 |
| WO | WO 00/34573 | A1 | 6/2000 |
| WO | WO 00/34574 | A1 | 6/2000 |
| WO | WO 01/26592 | A1 | 4/2001 |
| WO | WO 01/26595 | A1 | 4/2001 |

OTHER PUBLICATIONS

Foulger, M. and J. Parisian, "New Developments in Hot Pressing," *Pulp & Paper Canada*, 101:2 (2000), pp. 47–49.

Hawes, J. Apertured Structures: A New Class of Porous Polymeric Press Fabrics, *Pulp & Paper Canada*, 100:12 (1999), pp. 103–105.

Mehmood, Bilal, "New Doctor Blade Technologies," *PAPTAC 87th Annual Meeting*, Jan. 30, 2001, pp. 139–142.

Parisian, Joe and Marc Foulger, "Wet End Application of Starch and Other Additives," *PAPTAC 87th Annual Meeting*, Jan. 30, 2001, pp. A23–A25.

"Resins and Compounds," *Modern Plastics Encyclopedia*, Mid Oct. 1988 Issue, vol. 65, No. 11, pp. 576–619.

Satas, Donatas, "Web Handling," *Web Processing and Converting Technology and Equipment*, Van Nostrand Reinhold Company, New York, 1984, pp. 394–401.

* cited by examiner

SYSTEMS FOR TISSUE DRIED WITH METAL BANDS

BACKGROUND OF THE INVENTION

Historically, creped tissue has been produced by adhesion against Yankee dryers or other heated drums to first dry the tissue, followed by creping with a doctor blade. More recently, the use of paired steel bands having a temperature differential between them has been proposed as a means of drying tissue, after which the tissue can be removed from one of the bands by creping or other means to cause the tissue to become foreshortened. An example of such a proposal is found in the PCT publication WO 99/32716, "Process and Apparatus for Making Foreshortened Cellulosic Structure," by C. A. McLaughlin et al., published Jun. 1, 1999, the U.S. counterpart of which, Ser. No. 08/994,927, filed Dec. 19, 1997, is herein incorporated by reference. The McLaughlin et al. reference discloses methods for foreshortening tissue which includes creping from tissue dried on a steel band in what is a version of a commercial drying concept known as the CONDEBELT™ marketed by Valmet Corp. (Finland). Related technology, in which differential temperature was used to remove moisture by a combination of and are described in a variety of patents and publications, including U.S. Pat. No. 4,112,586 issued on Sep. 12, 1978; U.S. Pat. Nos. 4,506,456 and 4,506,457 both issued on Mar. 26, 1985; U.S. Pat. No. 4,899,461 issued on Feb. 13, 1990; U.S. Pat. No. 4,932,139 issued on Jun. 12, 1990; and U.S. Pat. No. 5,594,997 issued on Jan. 21, 1997, all foregoing patents issued to Lehtinen; U.S. Pat. No. 4,622,758 issued on Nov. 18, 1986 to Lehtinen et al.; and, U.S. Pat. No. 4,958,444 issued on Sep. 25, 1990 to Rautakorpi et al., all of which are herein incorporated by reference.

A potential limitation in the embodiments discussed above is the problem of nonuniformity in temperature, web adhesion, and topography (flatness) of the steel bands, particularly in the cross direction, whereby web breaks may occur during creping or other foreshortening operations, or whereby nonuniform product may be obtained. While the CONDEBELT™ system may provide improved temperature uniformity across the majority of the web in current machines, the potential for temperature variability may increase with increases in machine width or speed, resulting in more severe cross-direction temperature gradients. For example, cooler edges and hotter central portions of the belt may cause deflection of one segment of the steel band relative to other segments of the steel band, thus presenting a non-uniformity or distortion of the flat surface of the steel band from which the tissue would be creped. Uniformity of the surface of the steel band beneath the tissue is important when using a straight creping blade. Improved mechanisms for maintaining good thermal uniformity in the cross-direction and/or geometric uniformity of the surface of the steel band (flatness, for example) are needed, not only for the steel bands, but the support structures for the steel bands and the structures that support pressure chambers and other components of the system.

Further, the surfaces of the steel bands at high temperature, when pressed against a low-basis weight web such as tissue, are likely to present challenges in web removal. A sudden drop in applied pressure as the web leaves the compression zone of a CONDEBELT™ press may result in delamination, when the internal steam pressure in the web is suddenly no longer balanced by externally applied pressure. Controls are needed to prevent delamination. A further problem associated with removal of the web from the CONDEBELT™ system is that some parts of the web may adhere strongly to the surface of the steel band while other parts of the web are adhered less strongly at the point of removal from the surface of the steel band, resulting in the potential for poor creping if a crepe blade is used to remove the web, or resulting in web breakage if the web is pulled off the surface of the steel band, as could occur if differential velocity transfer to a slower moving web were used. The adhesion to the surface of the steel band is not only a function of temperature and the uniformity of any adhesives applied and of any pressing force used to contact the web to the surface of the steel band, but is also affected by the surface energy of the surface of the steel band, which in turn can be strongly dependent on oxidation of the surface of the steel band or the build up of mineral deposits or the build up of other chemicals on the surface of the steel band. Improved surface treatments of the steel bands are needed to promote uniformity of the surface of the steel band, to prevent oxidation or other sources of nonuniformity in surface energy, and to promote good web release, especially when creping is not used to remove the web.

Further still, nonuniform sheet properties and runnability problems may occur unless measures are taken to provide uniform, intimate contact of the web to the steel band. When a moist web contacts a heated metal surface, the potential for blistering (steam pockets causing portions of the web to move away from the heated surface or to have nonuniform contact against the surface) or other uniformity problems needs to be considered and prevented. Thus, there is a need for process improvements over what has been proposed to ensure that good, intimate contact between the tissue and the contacting steel band is achieved, preferably prior to entering the dryer section or immediately thereupon.

Also neglected in the art is the utility of metal band systems for the production of latex-reinforced tissue, particularly for double-creped products.

SUMMARY OF THE INVENTION

While it is known that foreshortened cellulosic webs can be produced using dryers having moving belts or other moving press surfaces that are substantially parallel for a distance, wherein the dryer applies a temperature differential across the thickness of the web, such devices can be improved with means for reducing heterogeneity in the web. Undesired heterogeneity can be due to poor cross-directional control of drying, web properties, belt tension, belt or web topography (especially when creping is used), and the like, or can be due to nonuniform or poorly controlled surface or thermal properties of the belts or other moving press surfaces. Reduced heterogeneity can be achieved with a control system for detecting and reducing cross-directional variability. The control system can respond to sensors measuring temperature or flatness of the web or a moving belt, surface topography of the web, local tension in the web, elastic modulus of the web, and the like. Alternatively or in addition, reduced heterogeneity can promoted with durable coatings on at least one of the moving press surfaces (e.g., a metal press belt that contacts the cellulosic web) to improve heat flux into the web, contact of the web to the press belt, release of the web from the press belt, or other factors affecting the drying, foreshortening, or material properties of the web.

Heterogeneity can also be occur when there is incipient or fully developed delamination of a web upon exiting a compression zone with a temperature differential, or in general by a sudden change in applied pressure while heated. Such heterogeneity can be reduced by control of the depressurization of the web or the applied temperature of the web prior to exiting a compression zone, such as by providing a decompression zone for a more gradual change in pressure, or by providing an intermediate open zone before completely exiting the drying device which can permit the release of steam in the web (and also partly cool the web) or can permit for measurement or treatment of the web prior to completion of drying. Such treatment can refer to application of profiled heating or cooling of the web, and/or application of additives. Other strategies involving cross-directional control of properties of the web, the moving press surfaces, the applied pressure or heat flux, and so forth, can also be useful in reducing delamination or other problems associated with intense drying operations.

Improved press belt structures can also lead to improved drying performance or more uniform web properties.

DETAILED DESCRIPTION

Figure 1:
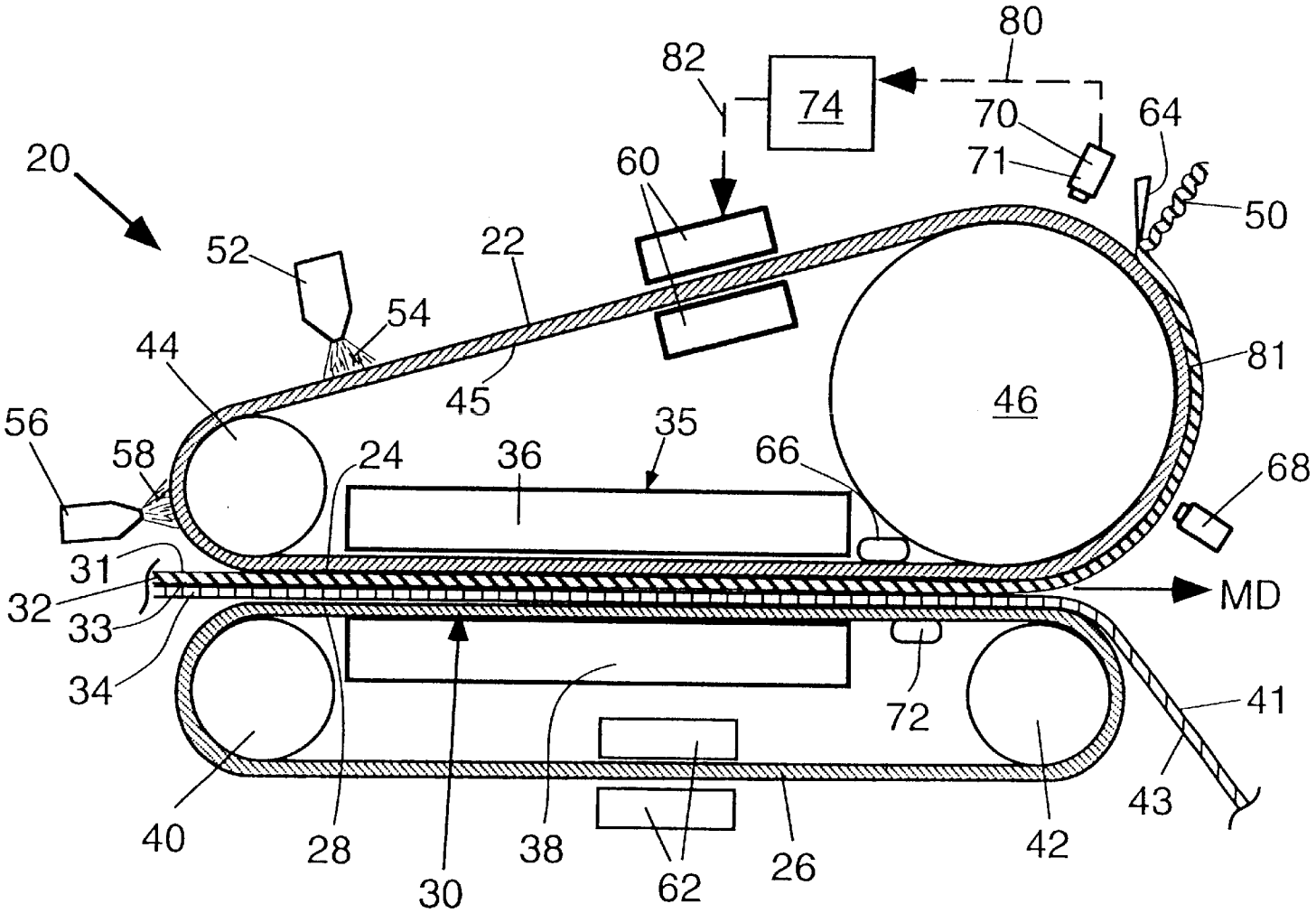
FIG. 1 depicts a drying and creping section of a machine according to the present invention.

FIG. 1 depicts a drying apparatus 20 that is part of a machine (not shown) for the production of a fibrous product such as creped tissue 50. The fibrous web 32 may be a wet paper fibrous web 32 produced by a gap former, crescent former, Fourdrinier, or other formation method known in the art (not shown) and can be provided on a foraminous dryer fabric 34, which, by way of example, may be a conventional drying fabric or a woven fabric with elevated resinous elements thereon, or a metal mesh. The fibrous web 32 may also be an airlaid web, such as one that has been partially wetted by impregnation of an aqueous foam or an aqueous latex emulsion. The dryer fabric 34 is vapor permeable and preferably also fluid permeable, and has a web-side surface 41 (the side of the dryer fabric 34 in contact with the fibrous web 32) and a backside surface 43 of the dryer fabric 34 opposite to the web-side surface 41. The fibrous web 32 and the web-side surface 41 of the dryer fabric 34 are pressed between two mutually opposed first and second press belts 22 and 26, respectively, which may be endless metal bands. The first press surface 24 of the first press belt 22 contacts the fibrous web 32 in a compression zone 30, and the second press surface 28 of the second press belt 26 contacts the backside surface 43 of the dryer fabric 34. In the compression zone 30, the first and second press surfaces 24 and 28 are substantially equidistantly spaced apart from each other (i.e., the first and second press surfaces 24 and 28 are substantially equidistantly spaced from each other (i.e. the surfaces may be linear and substantially parallel, or may define portions of two concentric arcs, or the like).

While the first and second press surfaces 24 and 28 may be flat or curved, flat structures of the first and second press surfaces 24 and 28 in the compression zone 30 as depicted can provide high nip residence times in elongated drying regions having simple geometry and low equipment cost. An additional fabric (not shown) can be provided between the dryer fabric 34 and the second press surface 28 of the second press belt 26. The fibrous web 32 and the dryer fabric 34 are interposed between the first and second belts 22 and 26 and pressed thereby within the compression zone 30 by a pressure controlled by a pressing means 35 which may include, but is not limited to, devices juxtaposed between the first and second press belts 22 and 26 and pushing the first and second press belts 22 and 26 towards each other within the compression zone 30. Such devices can include one or more of the following features, including but not limited to, pressurized chambers, roll surfaces with applied loads, means for generating mechanical force against the belts, or the like known in the art. The pressure can also be controlled by the longitudinal tension of the first and second press belts 22 and 26 and a clearance between the sections of the first and second press belts 22 and 26 comprising the compression zone 30 therebetween.

An upper pressure chamber 36, as shown in FIG. 1, can be provided adjacent to the backside surface 45 of the first press belt 22 (the side of the first press belt 22 away from the fibrous web 32), and may comprise a steam chamber operating at an elevated pressure to both press and heat the fibrous web 32, thus allowing the upper pressure chamber 36 to serve as a pressure generating device. An opposing device 38 can also be provided to operate in a cooperative relationship with the upper pressure chamber 36 to resist the pressure provided by the upper pressure chamber 36, preventing excessive deformation of the first and second press belts 22 and 26 and assisting in the compression of the fibrous web 32. The opposing device 38 may be a lower pressure chamber applying pressure similar to that of the upper pressure chamber 36, or can be a static or moving mechanical device applying a mechanical load to the second press belt 26. The opposing device 38 may also be a cooling chamber which provides cooling for improved water removal from the fibrous web 32. For example, the opposing device 38 may comprise pressurized cold water in direct contact with the second press belt 26, sealed at or near the edges of the nips within the compression zone 30 to prevent or reduce water loss from the opposing device 38. Likewise, the opposing device 38 may comprise cooling jets (not shown) of water or air directed against the second press belt 26 to cool it. Low-friction foils, cross-bars, or other support means in the opposing device 38 can resist excessive deformation of the second press belt 26 and partially resist the pressure applied by the pressure chamber 36.

The gauge pressure in the upper pressure chamber 36, as well as the pressure applied to the fibrous web 32, can be from 50 kilopascals (kPa) to 2 megapascals (MPa), and specifically can be from 100 kPa to 600 kPa, and more specifically from 200 kPa to 500 kPa. The width of the first and second press belts 22 and 26 can be from 0.5 meters to 15 meters, more specifically from 2 meters to 8 meters, and most specifically from 3 meters to 6 meters. Machine speed can be from 0.5 meters per second (m/s) to 40 m/s, more specifically from 3 m/s to 30 m/s, and most specifically from 10 m/s to 25 m/s.

Under the pressure caused by the first and second press surfaces 24 and 28 of the first and second press belts 22 and 26, respectively, in cooperation with other pressure causing devices, wherein the first press surface 24 of the first press belt 22 imprints the fibrous web 32 into the dryer fabric 34, at least selected portions of the fibrous web 32 become densified and adhered to the first press surface 24 of the first press belt 22 which can be treated with a creping adhesive. The creping adhesive may be applied to the first press surface 24 of the first press belt 22 uniformly, or according to a pre-selected pattern. An adhesive applicator may comprise a printing roll, spraying nozzles, extrusion devices, or other devices known in the art. First and secondary delivery devices, such as spray nozzles, 52 and 56 are shown in FIG. 1, either one of which is capable of applying an adhesive spray 54 or 58, respectively.

Both the process and the drying apparatus 20 are equally applicable for making a fibrous web 32 having either pattern densified regions or having substantially even distribution of density.

Whether the opposing device 38 provides affirmative cooling or not, it is preferred that a substantial temperature gradient be imposed between the first and second press surfaces 24 and 28 of the first and second press belts 22 and 26, respectively, whereby the belt-contacting side 31 of the fibrous web 32 is hotter than the fabriccontacting side 33 of the fibrous web 32. Without wishing to be bound by theory, it is believed that efficient water removal can be driven by a suitable temperature differential whereby water is vaporized in the fibrous web 32 due to energy transfer from the first press surface 24 of the first press belt 22, and whereby the vapor passes from the fibrous web 32 into the dryer fabric 34, where the water vapor is condensed due to the cooler temperature of the second press surface 28 of the second press belt 26. Further water transport from the fibrous web 32 to the dryer fabric 34 occurs via bulk flow as the fibrous web 32 is pressed within the compression zone 30. Thus both bulk flow and vapor transport and condensation drive water from the fibrous web 32 to the dryer fabric 34.

Independent of any heat applied by the upper pressure chamber 36, heating of the first press belt 22 can also be applied by a heating device 60 which may be an inductive heater, a gas fired heater, a radiative heater, a steam heater, a heat exchanger in which heat from steam or heated thermal fluids is transferred to the first press belt 22, or the like known in the art. Likewise, independently of any cooling applied by the opposing device 38, the cooling of the second press belt 26 can also be provided by a cooling device 62 which may provide contact with chilled water or other fluids or gases, or may be a refrigerated chamber, an air cooling unit in which room temperature air cools the second press belt 26, a heat exchanger, or the like known in the art. Contact with cold water, for example, can be simple and economical in some embodiments.

It can be desirable to remove free water from the fabric-contacting second press surface 28 of the second press belt 26 prior to entry into the compression zone 30 by a rubber wiper blade, an air knife, absorbent pads, air dryers, or other means (not shown) known in the art.

The first press belt 22 is conveyed in an endless loop by the action of an upper first turning roll 44 and an upper second turning roll 46, depicted in FIG. 1 as being larger in diameter than the upper first turning roll 44. Likewise, the second press belt 26 is conveyed in an endless loop by the action of lower first and second turning rolls 40 and 42, respectively. The present invention is not limited to devices comprising turning rolls, however, for alternate devices known in the art may be used. Moving chains, tracks, rotating arms and linkages, or the like known in the art, may be used to convey the first and second press belts 22 and 26 through the compression zone 30. Stationary bars or shoes can also be used as turning rolls 44 and 46, though lubricant may be needed to prevent excessive wear of the first and second press belts 22 and 26.

The upper second turning roll 46 may be heated or unheated (such is true of all turning rolls in the present invention). In the heated embodiment of the present invention, it can be a steam-filled roll or other heated cylinders or rolls, such as an internally heated gas-fired roll (ABB Flakt's Gas Heated Paper Dryer), an inductively heated drying roll, an impulse drying roll such as those disclosed in U.S. Pat. No. 5,353,521, issued on Oct. 11, 1994 to Orloff; and U.S. Pat. No. 5,598,642, issued on Feb. 4, 1997 to Orloff et al., or the like known in the art. The upper second turning roll 46 can also be a hot roll press (HRP), as described by M. Foulger and J. Parisian in "New Developments in Hot Pressing," *Pulp and Paper Canada,* 101 (2): 47–49 (February 2000). The upper second turning roll 46 may also be a means of controlling the cross-directional temperature profile of the fibrous web 32 and/or the first press belt 22, responsive to detection means hereafter described.

For either of the first and second belts 22 and 26, or the fibrous web 32 itself, uniformity of temperature, sheet structure, and topography can be checked by sensors 66, 68, 70, and 72, which can detect nonuniformity in the cross-direction, and optionally track changes in the machine direction or changes in time. Sensor measurements can be coupled to the heating and cooling means for the first and second press belts 22 and 24, such as the heating device 60, the heating mechanisms in the upper pressure chamber 36, the cooling device 62, the cooling mechanisms in the upper pressure chamber 36, or to other heating or cooling devices known in the art (not shown) for adjusting the cross-directional temperature profiles of the first press belt 22 and optionally of the second press belt 26. In the embodiment of FIG. 1, a first sensor 66 measures the cross-directional profile for temperature, flatness, or belt tension in the first press belt 22. The temperature sensors may be contact thermocouples, including revolving thermocouples, pyrometers, infrared temperature monitors, or the like known in the art. It is preferable for the temperature sensors to be equipped multiple sensing devices spaced apart in the cross-direction to provide a more complete profile.

The flatness sensors may be optical interferometers such as a CADEYES™ Moiré interferometer from Integral Vision (Dearborn, Mich.), laser triangulation devices that either scan the cross direction or that comprise multiple lasers across the cross direction, ultrasonic and acoustic position sensors, a bank of rolling wheels each mounted to a position detector such as an LVDT (linear vertical displacement transducer) sensor, eddy current sensors for detecting the position of ferrous metals, or the like known in the art.

The tension sensors can be devices which measure tension in response to ultrasonic signal characteristics in the first press belt 22, deformation characteristics of the first press belt 22 in response to pressure from a rolling wheel, acoustic signals generated by an impact or "ping" of a metal belt, or the like known in the art. The belt tension may also be measured by a plurality of strain gages in the cross direction connected to segmented or sectional rollers (or a plurality of separate rolls spaced apart in the cross direction) about which the first or second press belt 22 or 26 wraps, whereby the force against a roller is directly related to the tension in the first or second press belt 22 or 26. A plurality of counterbalanced dancer rolls spaced apart in the cross direction can also be used to measure local belt tension. The use of dancer rolls to measure web tension is discussed by Donatas Satas in *Web Handling and Converting Technology and Equipment,* New York: Van Nostrand Reinhold Company, 1984, pp. 394–401, herein incorporated by reference.

The first sensor 66 may comprise one or more types of the sensors discussed above in a plurality of positions to provide cross-directional information about the first press belt 22.

A second sensor 68 is depicted in FIG. 1 as an optical sensor for evaluating the state of the fibrous web 32 prior to creping. A flatness sensor or topography measurement device can be used, operating on principles such as Moiré interferometry, laser triangulation, speckle interferometry, or even simple image analysis at high speed. Other detection modes can be considered, such as ultrasonic signal analysis for surface position or for elastic properties of the fibrous web 32.

A third sensor 70 is also depicted as an optical device for evaluating the flatness of the fibrous web 32. A fourth sensor 72 can be any of the devices described with respect to the first sensor 66. While one sensor may suffice for the purposes of the present invention, a plurality of sensors may be used.

The cross-directional profile information about the first press belt 22 and optionally the second press belt 26 obtained by one or more sensors 66, 68, 70, and 72 is provided as input in a control system 74. In FIG. 1, dotted lines represent signal pathways 80 and 82 showing the transmission of information from the third sensor 70 to the control system 74 and from the control system 74 to the heating device 60, which responds to a measured cross direction profile of a property by selectively adjusting the cross-directional profile of applied energy from the heating device 60 to improve the uniformity of the tissue production operation or other paper drying operation. (Alternatively, a cooling device with CD profile control, not shown, could be used in place of the depicted heating device 60.) Similar pathways could be drawn for each of the other sensors 66, 68, and 72, but are not shown for clarity. The pathway 82 could also be drawn from the control system 74 to any or all of the heating and cooling means in the apparatus 20, including the first and secondary delivery devices, such as spray nozzles, 52 or 56.

In one example, a bank of air nozzles (not shown) is installed across the cross direction of the first press belt 22 in which each air jet can provide hot air or room temperature air to impinge on the first press belt 22, offering cross-directional profiling capabilities for temperature and properties related to temperature (temperature-induced in-plane expansion and contraction of the first press belt 22, for example, can also affect flatness of the first press belt 22 as well as tension in the first press belt 22). A flatness sensor 71, such as the third sensor 70, may detect a region where buckling or out-of-plane deflection is occurring in the first press belt 22 due to elevated temperature at that cross-directional position. In response, air jets acting at that position may provide room temperature air or chilled air to cool the first press belt 22 and correct the buckling.

In one embodiment, the position of the ends of the upper second turning roll 46 can also be adjusted responsive to signals from the sensors 66, 68, and 70 to maintain proper tension in the first press belt 22. In another embodiment, the upper second turning roll 46 is a crown-compensated device wherein internal hydraulics can adjust the crown of the upper second turning roll 46 in discrete segments responsive to defects in the topography of the first press belt 22. Adjustment of the roll position or the crown of the upper second turning roll 46 can be in addition to the adjustments provided by temperature profiling as described above.

After the fibrous web 32 has been dried, it can be removed in a foreshortening operation such as creping with a crepe blade 64, as shown in FIG. 1, or by differential velocity transfer to a slower moving fabric or surface (not shown). Successful creping typically requires the presence of an adhesive layer 81 joining the fibrous web 32 to the first press surface 24 of the first press belt 22, thus typically requiring that adhesives be applied to the first press surface 24 of the first press belt 22, as discussed hereafter. Computer control of the geometry and load of the crepe blade 64 can also be used to optimize product quality. If creping is used, the crepe blade 64 need not be positioned as shown in FIG. 1, where it is opposed by the upper second turning roll 46, but may positioned between the upper first turning roll 44 and the upper second turning roll 46, either opposed by another roll (not shown) or other opposing surface, or unopposed, wherein the force exerted by the crepe blade 64 would cause some deflection of the first press belt 22 toward the compression zone 30.

The crepe blade 64 can be any kind known in the art, including a beveled metal blade, the ProCrepe® bi-metal blades of ThermoWeb Systems (Auburn, Mass.), composite blades comprising natural fibers or carbon fibers in a resinous matrix, serrated blades, oscillating blades, dual or triple blade systems or other multiple blade combinations, and the like. Exemplary serrated or undulatory crepe blades are disclosed in U.S. Pat. No. 5,885,415, issued on Mar. 23, 1999 to Marinack et al., herein incorporated by reference. Bi-metal blades are described in more detail by B. Mehmood, "New Doctor Blade Technologies," *Proceedings of the PAPTAC 87th Annual Meeting,* Montreal, Canada, January 30 to Feb. 1, 2001, vol. A, pp. 139 to 142.

The removal of the fibrous web 32 from the first press surface 24 of the first press belt 22 can also be achieved with the aid of an air jet, wherein a thin, high velocity jet of gas can help detach or guide the motion of the fibrous web 32. The fibrous web 32 should have sufficient strength to withstand the aerodynamic forces that may be imposed on the fibrous web 32. One useful approach combining a creping blade with an air jet behind the creping blade is disclosed in U.S. Pat. No. 4,185,399, "Doctor Blade, Drying or Sealing Assembly," issued on Jan. 29, 1980 to Gladish, the contents of which are herein incorporated by reference. An air jet (not shown) can also operate to remove the fibrous web 32 from the first press surface 24 of the first press belt 22 without the continuous operation of the crepe blade 64 provided that the attachment forces holding the fibrous web 32 against the first press surface 24 of the first press belt 22 are weak enough (as mitigated with the presence of release agents or the lack of crepe adhesive) for successful removal with an air jet. The air jet may also serve to transport the detached fibrous web 32 toward another fabric (not shown). In addition, the air jet may be set to travel at a lower velocity than the first press belt 22 to effect a differential velocity transfer and foreshortening of the fibrous web 32. Principles for the use of an air jet in the foreshortening of a web are disclosed in commonly owned U.S. application Ser. No. 09/113,772, "Transfer of a Cellulosic Web between Spaced apart Transport Means Using a Moving Air as a Support" by Lindsay and Kamps, filed on Jul. 10, 1998, herein incorporated by reference. An air jet may also serve as part of a rush transfer step after the fibrous web 32 has been creped by a crepe blade 64, using a configuration such as that disclosed in U.S. Pat. No. 5,830,321, issued on Nov. 3, 1998 to Lindsay et al., herein incorporated by reference, with particular attention being drawn to the embodiment shown in FIG. 6 therein.

Prior to contacting the fibrous web 32, the first press surface 24 of the first press belt 22 may be sprayed or coated with a first composition 54 applied by a first delivery device 52 for better contact with the fibrous web 32. The first composition 54 may comprise crepe adhesives and release agents known in the art. The first delivery device 52 is depicted in FIG. 1 as a spray boom, however, the first delivery device 52 may be a slot or curtain coater, a flooded nip, a metered roll coater, an electrostatic spray system, a bank of nozzles applying oscillating jets, an ink jet printing head, a transfer roll, a flexographic printer (or offset or gravure printing devices), or the like known in the art.

An optional secondary delivery device 56 may provide a second composition 58 to the first press surface 24 of the first press belt 22 or to the surface of the fibrous web 32 prior to entering the compression zone 30. The second composition 58 may be applied uniformly or only to a portion of the first press surface 24 of the first press belt 22 or the surface of the fibrous web 32 being treated, as in a regular or random pattern. In one embodiment of the present invention, the second composition 58 is substantially the same as the first composition 54, such as an adhesive mixture, except that one of the two compositions 54 and 58 is more dilute (more water or other solvent is present), which can be useful in controlling temperature and tackiness of the first press surface 24. In one embodiment (not shown), the spray, which can be substantially pure water, is applied nonuniformly in the cross direction (i.e., the water spray is profitable along the cross-direction) across the surface of the first press belt 22 responsive to the control system 74 to cool the first press belt 22 in specific zones in order to enhance cross-directional uniformity of the first press belt 22 and the creping process. The second composition 58 can comprise any of the materials mentioned for the first composition 54. In another embodiment, one of the first or secondary delivery devices 52 or 56 applies one of the compositions 54 or 58 comprising a release agent such as a debonder, a lubricant, a silicone, and the like, while the other delivery device 52 or 56 applies the other composition 54 or 58 comprising an adhesive. As used herein, a heating or cooling means is said to be "profitable" in the cross-direction if it can be applied nonuniformly to create a cross-direction profile in the intensity of heating or cooling, respectively. Profilable heating or cooling may be achieved by local application of heating or cooling, respectively, in one zone, or by variable application in a plurality of zones or by continuously variable application of heating or cooling, respectively.

The first and second composition 54 and 58 may comprise any crepe adhesives known in the art, including but not limited to, epichlorohydrin compounds such as Kymene, polyvinyl alcohol, starch derivatives, polyamines such as polyvinylamines (e.g., Catiofast™ compounds from BASF, Ludwigshafen, Germany) or polyallylamines, various gums, any known latex, polyacrylamides, and the like. The adhesive compounds can be water soluble or insoluble in water. A suitable hotmelt adhesive compound may also be applied.

Debonding agents or release agents may also be applied in the first composition 54, the second composition 58, in the furnish used to produce the wet fibrous web 32 (not shown), or to the surface of the fibrous web 32 itself (not shown). The debonders can be useful in controlling the release properties of the fibrous web 32 from the first press surface 24 of the first press belt 22. The debonders may include silicone compounds, mineral oil and other oils or lubricants, quaternary ammonium compounds with alkyl side chains, or the like known in the art. The suitable debonders may include any number of quaternary ammonium compounds and other softeners known in the art, including but not limited to, Berocell 596 and 584 (quaternary ammonium compounds) manufactured by Eka Nobel Inc., which are believed to be made in accordance with U.S. Pat. Nos. 3,972,855 and 4,144,122; Adogen 442 (dimethyl dihydrogenated tallow ammonium chloride) manufactured by Sherex Chemical Company; Quasoft 203 (quaternary ammonium salt) manufactured by Quaker Chemical Company; Arquad 2HT75 (di(hydrogenated tallow) dimethyl ammonium chloride) manufactured by Akzo Chemical Company; mixtures thereof; and, the like known in the art.

Softening agents known in the art of tissue making may also serve as debonders or hydrophobic matter suitable for the present invention and may include but not limited to: fatty acids; waxes; quaternary ammonium salts; dimethyl dihydrogenated tallow ammonium chloride; quaternary ammonium methyl sulfate; carboxylated polyethylene; cocamide diethanol amine; coco betaine; sodium lauroyl sarcosinate; partly ethoxylated quaternary ammonium salt; distearyl dimethyl ammonium chloride; methyl-1-oleyl amidoethyl-2-oleyl imidazolinium methylsulfate (Varisoft 3690 from Witco Corporation); mixtures thereof; and, the like known in the art.

Surfactants may also be included in the first or second compositions 54 or 58 or otherwise applied to the fibrous web 32 or the first press surface 24 of the first press belt 22. The surfactants may be anionic, cationic, or non-ionic, including but not limited to: tallow trimethylammonium chloride; silicone amides; silicone amido quaternary amines; silicone imidazoline quaternary amines; alkyl polyethoxylates; polyethoxylated alkylphenols; fatty acid ethanol amides; dimethicone copolyol esters; dimethiconol esters; dimethicone copolyols; mixtures thereof; and, the like known in the art.

Either or both of the first and second delivery devices 52 and 56 may be temperature controlled to provide a heated or cooled composition to the first press surface 24 of the first press belt 22. In one embodiment, the second composition 58 is applied at a higher temperature than the first composition 54, such as at least about 10° C. or about 20° C. temperature difference or greater. In another embodiment, the first composition 54 is applied at a higher temperature than the second composition 58, such as at least about 10° C. or about 20° C. temperature difference or greater.

During drying, the adhesive layer 81 applied to the first press surface 24 of the first press belt 22 by at least one of the first and second delivery devices 52 and 56 can be heated and cured, permitting good adhesion between the fibrous web 32 and the first press surface 24 of the first press belt 22. The adhesion of the fibrous web 32 to the first press surface 24 may be primarily restricted to specific portions of the first press surface 24.

The first press belt 22, particularly when it comprises a metallic band, can be coated with a durable coating adapted for improved release of the fibrous web 32 from the first press surface 24 of the first press belt 22, for improved runnability, or for improved heat transfer. As used herein, a coating is defined as "durable" if it can be applied to the first press surface 24 of the first press belt 22 prior to operation of the machine and can remain effective during continuous production for a period of time, such as at least 5 hours, without the need to be applied again during this period of time. Some durable coatings can remain in place for several weeks during continuous production. This is in contrast to the coating that typically builds up on the surface of a Yankee dryer, for example, during conventional creping of a tissue web, wherein adhesive agents must continuously be resupplied to the surface of the Yankee dryer to build up and maintain the coating, which is continuously being removed in part by the action of the crepe blade 64. The durable coating as applied to at least the first press surface 24 of the first press belt 22 may form a base on which crepe adhesives are built up. However, the durable coating may be especially useful when no creping adhesive is applied to the first press surface 24 of the first press belt 22. The durable coating may have a thickness of about 2 microns or greater, specifically about 10 microns or greater, more specifically about 50 microns or greater, and most specifically about 100 microns or greater, such as from about 30 microns to 300 microns, or from about 75 microns to 200 microns.

Whether durable or not, a coating on first press belt 22 may have a basis weight of about 10 gsm or greater, more specifically about 20 gsm or greater, more specifically still about 30 gsm or greater, and most specifically about 50 gsm or greater, such as from about 40 gsm to about 2000 gsm, or from about 15 gsm to about 90 gsm. The coating, whether durable or not, can be non-metallic or non-conducting. Alternatively, a durable coating can comprise metal or metallic particles, such as a porous layer of metallic particles applied by sintering, powder coating, or plasma coating. A porous coating can have a porosity of at least 10%, more specifically at least 20%, and most specifically from about 25% to about 60%. Alternatively, the porosity of the coating can be less than 10% and more specifically less than about 5%. The coating can be non-porous, with a porosity of substantially 0%.

An exemplary coating for good release is that used on the hot roll press (HRP), as described by M. Foulger and J. Parisian in "New Developments in Hot Pressing," *Pulp and Paper* Canada, 101(2): 47–49 (February 2000). The HRP comprises a thermal fluid heated Tri-Pass II press roll, supplied by SHW, Inc., with a ceramic or fluoropolymer coating for good web release. A fibrous web 32 is pressed onto the heated HRP roll, wherein the fibrous web 32 rides on the press roll until it is removed from the drum by contact with another fabric in a nip against another roll. The ceramic or fluoropolymer coating is believed to be particularly helpful when the fibrous web 32 of the present invention is removed without creping, such as by transfer to a slow moving roll. Without creping action to remove the fibrous web 32, a surface with good release properties is generally expected to be beneficial. Good release can also be provided by spraying a release agent on the surface of the fibrous web 32 or on the first press surface 24 of the first press belt 22 prior to the fibrous web 32 entering the compression zone 30. Such a release agent may be combined with the first composition 54 that may be an adhesive composition.

The opposing device 38 can be a vacuum chamber, a metal grill to resist deformation, a series of low friction shoes or bars, a moving belt supported by a shoe, the surface of a roll, a surface of an extended nip press, or the like known in the art. A lubricant may be applied between any stationary portions of the opposing device 38 and the moving second press belt 26 to reduce friction. In one embodiment of the present invention, the opposing device 38 comprises a chamber containing cooled liquid water which contacts the second press surface 28 of the second press belt 26 and reduces friction between the chamber.

Prior to being disposed on the dryer fabric 34 or while thereon, the fibrous web 32 may be dewatered by any means known in the art, including but not limited to foils, vacuum boxes, capillary dewatering devices, infrared or microwave drying, pneumatic dewatering, including the air press disclosed in WO 99/23296 by D. V. Lange, published on May 14, 1999, or WO 99/23301 by F. S. Hada et al., published on Oct. 30, 1998, both of which are herein incorporated by reference; displacement dewatering devices as described by J. D. Lindsay, "Displacement Dewatering To Maintain Bulk," *Paperi Ja Puu,* vol. 74, No. 3, 1992, pp. 232–242, or the like known in the art. Examples of useful capillary dewatering devices are described in U.S. Pat. No. 4,556,450, issued on Dec. 3, 1985 to Chuang et al.; U.S. Pat. No. 5,701,682, issued on Dec. 30, 1997 to Chuang et al.; and, U.S. Pat. No. 5,699,626, issued on Dec. 23, 1997 to Chuang et al., all of which are herein incorporated by reference.

The dryer fabric 34 can be a textured fabric such as Scapa Ribbed Spectra® fabrics or other Spectra™ fabrics of Voith Fabrics, (Appleton. Wis.), which employ rubbery polyurethane components or other polymer networks in the felt in the form of a porous membrane; the dryer fabrics disclosed in U.S. Pat. No. 5,508,095, issued on Apr. 16, 1996 to A. Allum et al.; the fabrics with extruded elevated thermoplastic or resin members adhered to a woven base fabric; the nonwoven molding substrates of U.S. Pat. No. 6,080,691, "Process for Producing High-Bulk Tissue Webs Using Nonwoven Substrates," issued on Jun. 27, 2000 to Lindsay and Burazin; or the drilled nonwoven webs disclosed in U.S. Pat. No. 4,541,895, issued on Sep. 17, 1985 to Hans Albert, all of which are herein incorporated by reference; or, the like known in the art.

In one embodiment of the present invention, the dryer fabric 34 is an apertured polymeric press fabric comprising a woven textile base, an apertured polymeric layer, and batt fibers, such as the fabrics described by J. Hawes, "Apertured Structures: A New Class of Porous Polymeric Press Fabrics," *Pulp and Paper Canada,* Vol. 100, No. 2, December 1999, pp. T375–377, with specific examples manufactured by Albany International Corp., Albany, N.Y. In related embodiments of the present invention, the woven textile base in the deformable carrier dryer fabric 34 can be replaced with a nonwoven spiral dryer fabric, which is formed by assembly of monofilament helical coils joined by pintles. The spiral fabrics are described by M. Di Ruscio in "Spiral Fabrics as Dryer Fabrics," *PaperAge,* January 2000, pp. 20–23, and are available from Albany Corp. (Albany, N.Y.). One embodiment thereof is described in U.S. Pat. No. 6,066,390, issued on May 23, 2000 to Quigley, herein incorporated by reference.

In another embodiment of the present invention, the dryer fabric 34 can be a textured imprinting fabric such as a substantially macroplanar fabric having deflection conduits and elevated regions, corresponding to any of the fabrics disclosed in U.S. Pat. No. 5,679,222, issued on Oct. 21, 1997 to Rasch et al.; U.S. Pat. No. 4,514,345, issued on Apr. 30, 1985 to Johnson et al.; U.S. Pat. No. 5,334,289, issued on Aug. 2, 1994 to Trokhan et al.; U.S. Pat. No. 4,528,239, issued on Jul. 9, 1985 to Trokhan; U.S. Pat. No. 5,098,522, issued on Mar. 24, 1992 to J. A. Smurkoski et al.; and, U.S. Pat. No. 4,637,859, issued on Jan. 20, 1987 to Trokhan. Other known imprinting fabrics for imparting a texture to a tissue web when pressed against a flat metal surface include U.S. Pat. No. 3,905,863, issued on Sep. 16, 1975 to Ayers; U.S. Pat. No. 3,974,025, issued on Aug. 10, 1976 to Ayers; U.S. Pat. No. 3,301,746, issued on Jan. 31, 1967 to Sanford and Sisson; U.S. Pat. No. 3,821,068, issued on May 21, 1974 to Salvucci, Jr. et al.; U.S. Pat. No. 3,974,025, issued on Aug. 10, 1976 to Ayers; U.S. Pat. No. 3,573,164, issued on Mar. 30, 1971 to Friedberg et al.; U.S. Pat. No. 3,473,576, issued on Oct. 21, 1969 to Amneus; and, U.S. Pat. No. 4,239,065, issued on Dec. 16, 1980 to Trokhan; all of which are incorporated herein by reference.

The imprinting fabrics can have elevated regions above a base fabric which can define a wide variety of patterns and geometrical features. For example, either the elevated regions or the deflection conduits between the elevated regions may define a pattern resembling any of the following: a series of interlocking rings; a staggered array of shapes such as semicircles, diamonds, dogbones, donuts, isolated rings, rectangles, sinusoidal structures resembling the symbol of waving flag, oval, or circular "islands" having areas resembling small lakes within the island or "lagoons" that penetrate into the island; circles with missing wedges creating the effect of a pie with one or more missing slices; an array of triangles of circles or any array of two or more simple shapes; and, the like. The elevated regions forming such patterns can have a uniform height or plurality of heights to impart complex surface texture, and can be formed from a single curable resin or from a plurality of components, whether stacked in layers or heterogeneously distributed across the plane of the fabric.

The interaction of a textured dryer fabric 34 with the fibrous web 32 in the compression zone 30 results in the texture of the dryer fabric 34 being imparted to the fibrous web 32. The imparted texture on the fibrous web 32 depends upon the applied pressure, the compressibility and moisture content of the fibers, the definition of the dryer fabric 34, and so forth.

The first press belt 22 and the dryer fabric 34 may be textured or planar, as described in WO 99/32716, "Process and Apparatus for Making Foreshortened Cellulosic Structure," published on Jul. 1, 1999 by McLaughlin et al., herein incorporated by reference.

The compression zone 30 can have a machine direction length of at least about 50 cm, more specifically about 1 meter, more specifically still about 2 meters, and most specifically about 3 meters, such as from about 1 meters to about 10 meters, or from about 2.5 meters to about 6 meters, and can comprise opposed convex and concave compression surfaces or a series of both convex and concave surfaces. The entrance to the compression zone 30 may further be provided with air removal systems such as vacuum systems at the inlet of the compression zone 30. The machine speed (speed of the first press belt 22.), for example, can be about 30 meters per minute (mpm) or greater, more specifically about 100 mpm or greater, more specifically still about 300 mpm or greater, and most specifically about 700 mpm or greater, with an exemplary range of from about 200 mpm to about 2000 mpm, or from about 400 mpm to about 1300 mpm.

In an alternative embodiment, the fibrous web 32 is not wet laid but is a dry laid fibrous web 32 such as an airlaid fibrous web 32 comprising cellulosic fibers and optional binder thermoplastic fibers. The airlaid fibrous web 32 can be substantially dry before entering the drying apparatus 20, or it can be premoistened by application of an additive or binding agent (e.g., impregnation with an aqueous latex emulsion applied as a spray or foam, or applied by coating). The fibrous web 32 is heated and optionally textured while in the compression zone 30, and then is removed from the drying apparatus 20. Removal can include creping the airlaid fibrous web 32 from the first press surface 24 of the first press belt 22. An airlaid fibrous web 32 suitable for treatment in the drying apparatus 20 can have a basis weight of from about 20 gsm to 700 gsm, more specifically from about 25 gsm to about 400 gsm, and more specifically still from about 25 gsm to 100 gsm. Alternatively, the fibrous web 32 may have a basis weight greater than 50 gsm or greater than 100 gsm.

An airlaid fibrous web 32 can be produced using any method known in the art, including the use of Dan Web air former equipment from Dan Web International, Denmark, or according to the method and apparatus of Dunning et al. disclosed in U.S. Pat. No. 3,825,381, issued on Jul. 23, 1974, herein incorporated by reference. Another useful airlaid technology suitable for forming tissue is disclosed in U.S. Pat. No. 4,375,448, "Method of Forming a Web of Air-Laid Dry Fibers," issued Mar. 1, 1983 to Appel et al., as well as U.S. Pat. No. 4,377,543, "Strength and Softness Control of Dry Formed Sheets," issued Mar. 22, 1983 to Strohbeen et al., both of which are herein incorporated by reference. Airlaid fibrous webs 32 may be formed with uniform thickness and basis weight, or may be formed with regions of varying density and basis weight through any method known in the art, including the methods of U.S. Pat. No. 6,098,249, issued on Aug. 8, 2000 to Toney et al.; U.S. Pat. No. 4,494,278, issued Jan. 22, 1985 to Kroyer et al.; U.S. Pat. No. 4,640,810, issued Feb. 3, 1987 to Laursen et al.; and U.S. Pat. No. 5,527,171, issued Jun. 18, 1996 to Soerensen, all of which are herein incorporated by reference.

A commercially available airlaid web is AIRTEXT™ 395 airlaid web sold by Georgia-Pacific Corporation (Atlanta, Ga.). AIRTEX™ 395 airlaid web is 100% virgin softwood held together by an acrylic binder. Concert Fabrication Ltee, of Ontario, Canada, also produces a variety of densified airlaid webs held together with thermoplastic binder material. A related material is coform, a hydraulically entangled mixture of pulp fibers and polymer, such as the materials disclosed in U.S. Pat. No. 4,879,170, issued on Nov. 7, 1989 to Radwanski et al.; U.S. Pat. No. 4,100,324 issued on Jul. 11, 1978 to Anderson et al.; and, U.S. Pat. No. 5,350,624 issued on Sep. 27, 1994 to Georger et al., the contents of which are incorporated herein by reference in their entireties. The airlaid or coform fibrous web 32 may be thermally bonded and can be flat with a uniform basis weight, or may have regions of elevated or depressed basis weight. Airlaid fibrous webs 32 comprising thermoplastic binder material that have been heated in the drying apparatus 20 may be subsequently molded, according to the teachings disclosed in commonly owned, copending applications Ser. No. 09/684,039, "Method of Making Molded Cellulosic Webs for Use in Absorbent Articles," by J. D. Lindsay et al., filed on Oct. 6, 2000 and Ser. No. 09/680,719 by F. J. Chen et al., "Absorbent Articles with Molded Cellulosic Webs," filed on Oct. 6, 2000.

Figure 2:
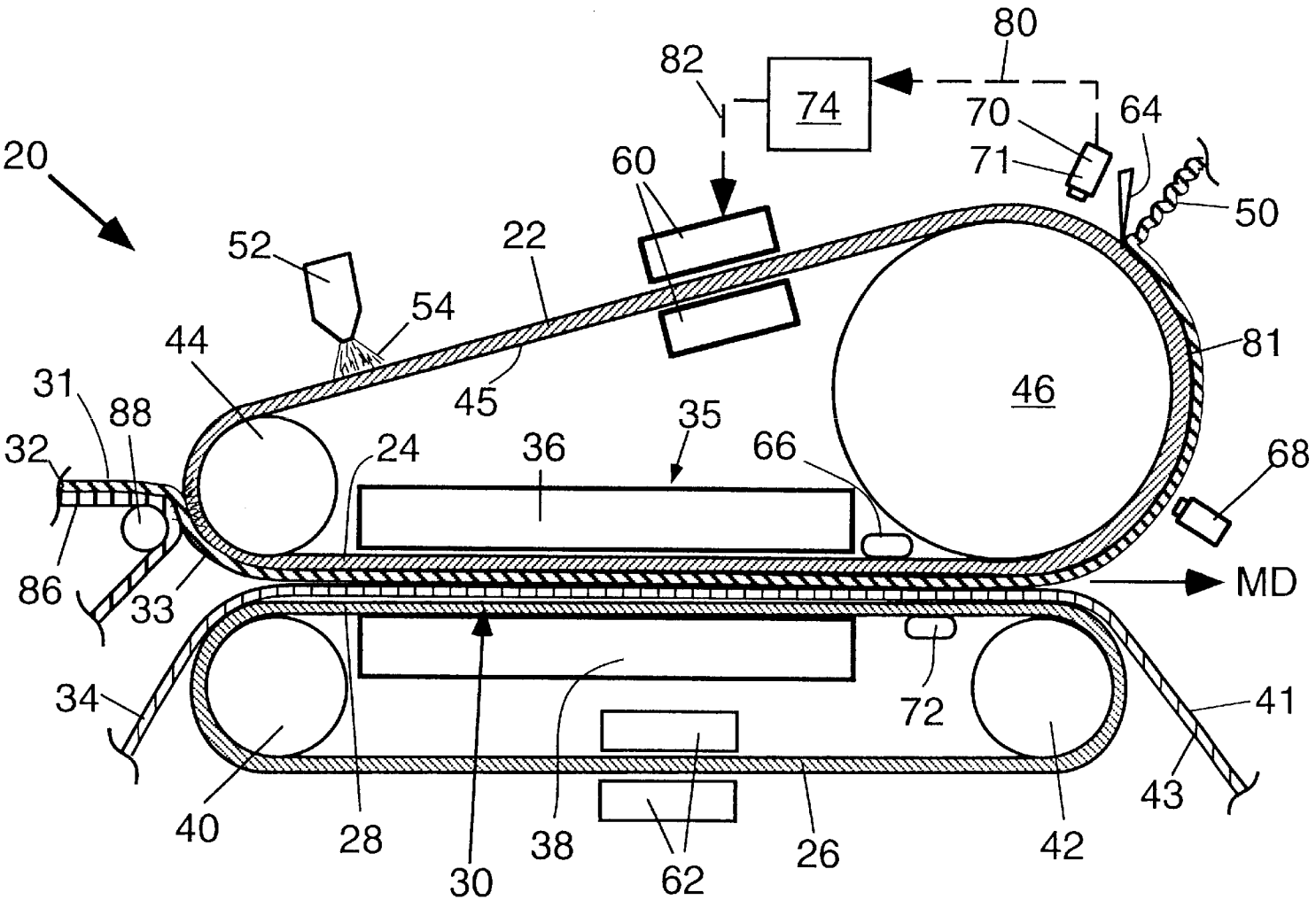
FIG. 2 depicts a second embodiment of a drying and creping section of a machine according to the present invention.

FIG. 2 provides an additional embodiment of the drying apparatus 20 of the present invention which is similar to that of FIG. 1 except that in FIG. 2, the fibrous web 32 is pressed against the first press surface 24 of the first press belt 22 as the first press belt 22 is turning around the first upper turning roll 44. The fibrous web 32 initially resides on a press felt 86. In this embodiment, the initial contact with a press belt 22 prior to entering the longitudinal compression zone 30 occurs at elevated pressure wherein the press roll 88 presses the fibrous web 32 against the first press surface 24 of the first press belt 22. In this manner, good contact with the heated first press surface 24 of the first press belt 22 is fostered and blistering, cockling, or other undesired forms of nonuniformity in the fibrous web 32 or in the drying of the fibrous web 32 is mitigated. The press load applied by the press roll 88 expressed in pounds per linear inch (pli) can be greater than 30, specifically greater than 100, more specifically greater than 400, and most specifically from about 80 to about 600.

Both the press felt 86 and the fibrous web 32 are pressed against the first press surface 24 of the first press belt 22 by a force applied by a press roll 88. Both the press roll 88 and the press felt 86 may be textured to imprint a pattern into the fibrous web 32 as the fibrous web 32 is pressed against the first press surface 24 of the first press belt 22. Further, the first press surface 24 of the first press belt 22 and the dryer fabric 34 may each have a pattern to create a textured fibrous web 32. The textured fibrous webs 32 according to the present invention can have bulks of about 4 cubic centimeters per gram (cc/g) or greater, more specifically about 7 cc/g or greater, more specifically still about 10 cc/g or greater, and most specifically about 12 cc/g or greater, with an exemplary range of from about 6 cc/g to about 18 cc/g, or from about 8 cc/g to about 14 cc/g.

Figure 3:
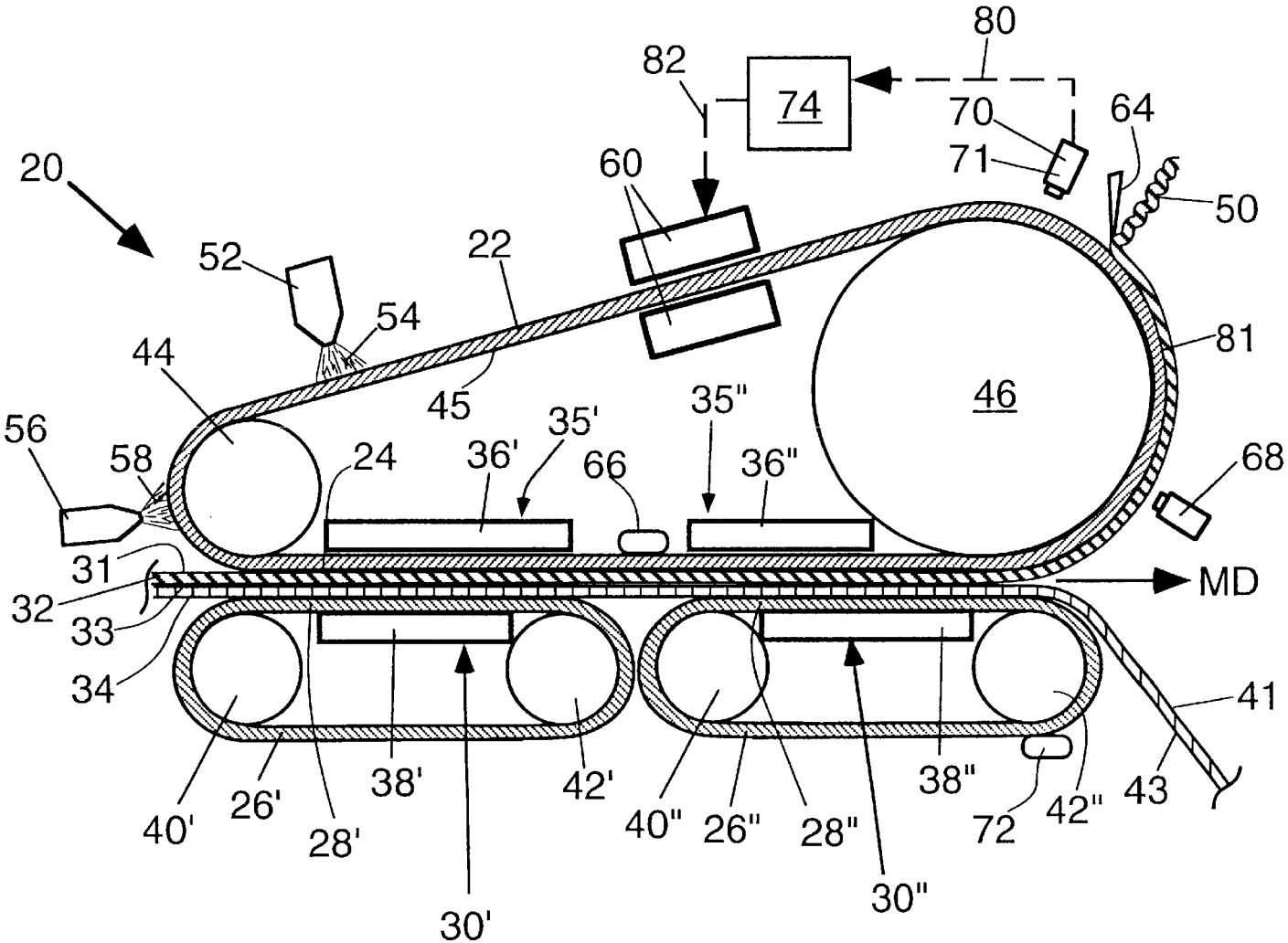
FIG. 3 depicts a drying apparatus in which the lower second press belt has been split into two endless loops.

FIG. 3 depicts an embodiment of the present invention related to that of FIG. 2 wherein the second press belt 26 of FIG. 1 has been replaced with a primary and secondary second press belts 26' and 26", respectively, with corresponding pairs of lower turning rolls 40' and 40" and 42' and 42", as well as first and second compression zones 30' and 30", respectively; first and second press devices 35' and 35", respectively; first and second upperpressure chambers 36' and 36", respectively; first and second opposing devices 38' and 38", respectively; and, primary and secondary second press surfaces 28' and 28", respectively. In this configuration, the heated first and second pressure chambers 36' and 36" and the cooled first and second opposing devices 38' and 38" provide the opportunity to better control the machine direction profiles for temperature and pressure of the primary and secondary second press belts 26' and 26". Thus, the pressure and temperature in the first compression zone 30' may differ from the pressure and temperature in the second compression zone 30". In one embodiment of the present invention, the initial temperature gradient and applied pressure in the first compression zone 30' are relatively low, such as a temperature gradient (difference between the temperature of the heated first pressure chamber 36' and the primary second press belt 26') of about 80° C. or less or 50° C. or less, and an applied pressure of about 0.7 MPa or less, or about 0.3 MPa or less, followed by substantially higher temperature gradients and pressures, such as a temperature gradient of about 90° C. or more or 120° C. or more, and an applied pressure of about 1 MPa or greater, or about 3 MPa or greater. Alternatively, the initial pressure can be high with a relatively low temperature difference, followed by a low pressure and a high temperature gradient.

The first and second pressure chambers 38' and 38" may also have a plurality of compartments at different pressure for applying a predetermined pressure profile to the fibrous web 32 as the fibrous web 32 passes in the machine direction. The compartments having varying pressures can also be established in the cross-direction to control moisture or physical property profiles in the cross-direction, possibly compensating for incoming nonuniformities in moisture content within the fibrous web 32, as measured by a gamma gauge or other moisture level sensors useful for moist fibrous webs 32. The cross-direction pressure and/or temperature profiles of the fibrous web 32 may also be used to improve cross-direction uniformity based on downstream web measurements, such as a measurement of physical properties taken for paper on a reel (not shown).

In another embodiment of the present invention (not shown), the dryer fabric 34 can be made integral with the second press belt 26 by lamination or other joining methods to bring the dryer fabric 34 and the second press belt 26 together into a unitary structure. As used herein, a "unitary" article refers to article formed as a single structure or as separate parts durably united together (i.e., not readily separable) to form a coordinated entity or article such that the parts do not require separate manipulation. To join a dryer fabric 34 and a second press belt 26 into a unitary structure, adhesive may be used, or a thermoplastic dryer fabric 34 could be welded against a porous metal surface on the impervious second press belt 26 to cause attachment, causing interpenetration of the polymer with the metal to form a weld. In another embodiment, the dryer fabric 34 is a metal mesh which can be spot welded or otherwise joined to a metal band serving as the second press belt 26. Further, the dryer fabric 34 can be replaced by providing a textured or porous surface on the second press belt 26 capable of receiving condensate generated by heating the fibrous web 32 in the compression zone 30 without allowing a large portion of the condensate to wick back into the fibrous web 32. Thus, a relatively thick metal band could be used as the second press belt 26, wherein the second press belt 26 has a plurality of wells in the metal surface sized such that the fibrous web 32 cannot easily penetrate to the bottom of the wells. For example, wells less than about 300 microns wide and deeper than about 200 microns in depth could be used, desirably occupying at least about 20% of the surface area of the second press belt 26, and more specifically occupying at least about 35% of the surface area. The condensate that accumulates in the wells after each pass through the compression zone 30 could be removed by an air knife, by blotting against an absorbent surface, by evaporation, by sonic or ultrasonic stimulation, by shaking, by inertial impact, by passing over a vacuum slot, or the like known in the art.

In another related embodiment, the second press belt 26 comprises a metallic mesh corresponding to the capillary dewatering belts in the technology of capillary dewatering, as described in U.S. Pat. No. 4,556,450, issued on Dec. 3, 1985 to Chuang et al.; U.S. Pat. No. 5,701,682, issued on Dec. 30, 1997 to Chuang et al.; or, U.S. Pat. No. 5,699,626, issued on Dec. 23, 1997 to Chuang et al., all of which are herein incorporated by reference. The capillary dewatering belt can be sealed on the back surface (the surface remote from the fibrous web 32) by being joined to an impermeable metal belt or by use of any other impermeable material, or the capillary dewatering belt can be porous throughout the thickness of the second press belt 26 to permit water removal from the backside of the second press belt 26.

If the second press belt 26 is to remain porous throughout its thickness, making it a permeable belt, the pressure applied by the opposing device 38 should be mechanical in nature as opposed to pressure provided by liquid or gas that could penetrate through the second press belt 26 and drive water back into the fibrous web 32 or add fluid to the fibrous web 32. Thus, the opposing device 38 may be a rigid but porous surface to offer a counter force to the pressure of the opposing device 38, while optionally also permitting removal of water from the back surface of the second press belt 26, and optionally permitting application of vacuum pressure to assist in water removal from the porous second press belt 26.

If a metallic second press surface 28 of the second press belt 26 is impervious but provided with dead-end pores or other structures for receiving condensate and no separate dryer fabric 34 is used, the second press surface 28 of the second press belt 26 can be provided with a release coating to reduce sticking of the fibrous web 32 to the second press surface 28 of the second press belt 26. For example, fluoropolymers, silicone release agents, and other materials can be applied to the second press surface 28 of the second press belt 26 to reduce the tendency of the fibrous web 32 to stick. The pores may also be optimized in shape, size, and distribution to provide good release properties as well.

Figure 4:
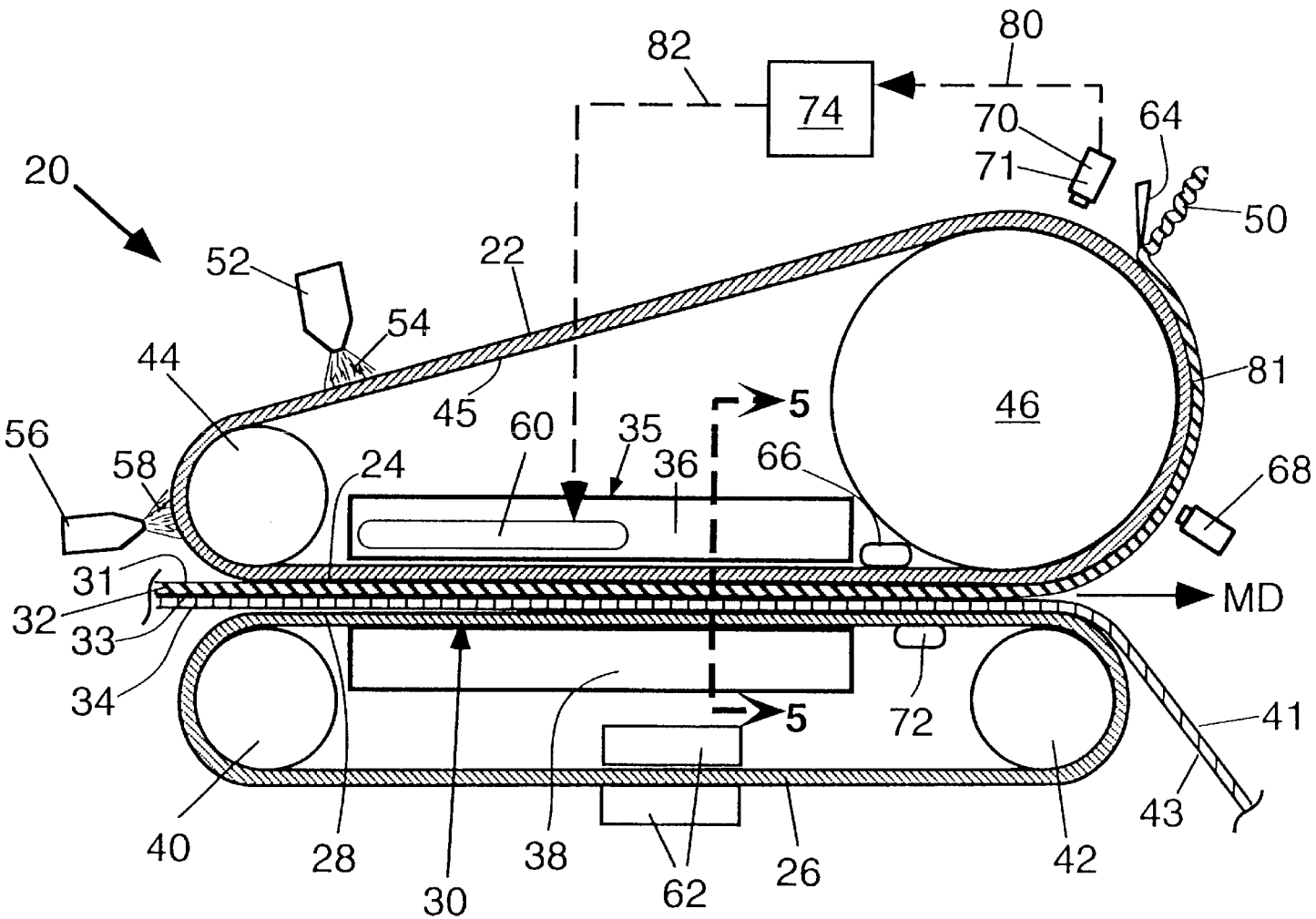
FIG. 4 depicts a drying apparatus in which heating of the first press belt occurs in the compression zone.

FIG. 4 depicts another embodiment of the drying apparatus 20 in which the heating device 60 applies heat to the first press belt 22 in the compression zone 30. In one embodiment, for example, the heating device 60 is an induction heater embedded in the upper pressure chamber 36 to cause the first press belt 22 to heat up substantially after having made contact with the fibrous web 32. The control system 74 regulates the energy applied by induction heating to maintain a good temperature profile in the first press belt 22. The control system 74 could also or alternatively regulate cooling of the first press belt 22 in the cross-direction, by providing input to regulate application of a cooling spray 54 or 58, or to regulate another cooling device (not shown) such as impinging jets of cool air or a refrigeration device.

With heating of the first press belt 22 occurring primarily in the compression zone 30 and/or by contact with a heated upper second turning roll 46, the first press belt 22 may be excessively hot when it contacts the fibrous web 32 unless the first press belt 22 has been cooled by the sprays of the first and second compositions 54 and 58 and/or by another cooling device (not shown) similar to the cooling device 62 shown for the second press belt 26. If the first press belt 22 is excessively hot, blistering of the fibrous web 32 may occur as vapor pressure from heated moisture in the fibrous web 32 seeks to escape through the fibrous web 32. This problem is more likely to occur if the fibrous web 32 has a high basis weight or low vapor permeability (including very wet webs). Thus, induction heating in the compression zone 30 may suitably be followed by cooling of the first press belt 22 in a manner designed to offer cross-direction temperature control.

Figure 5:
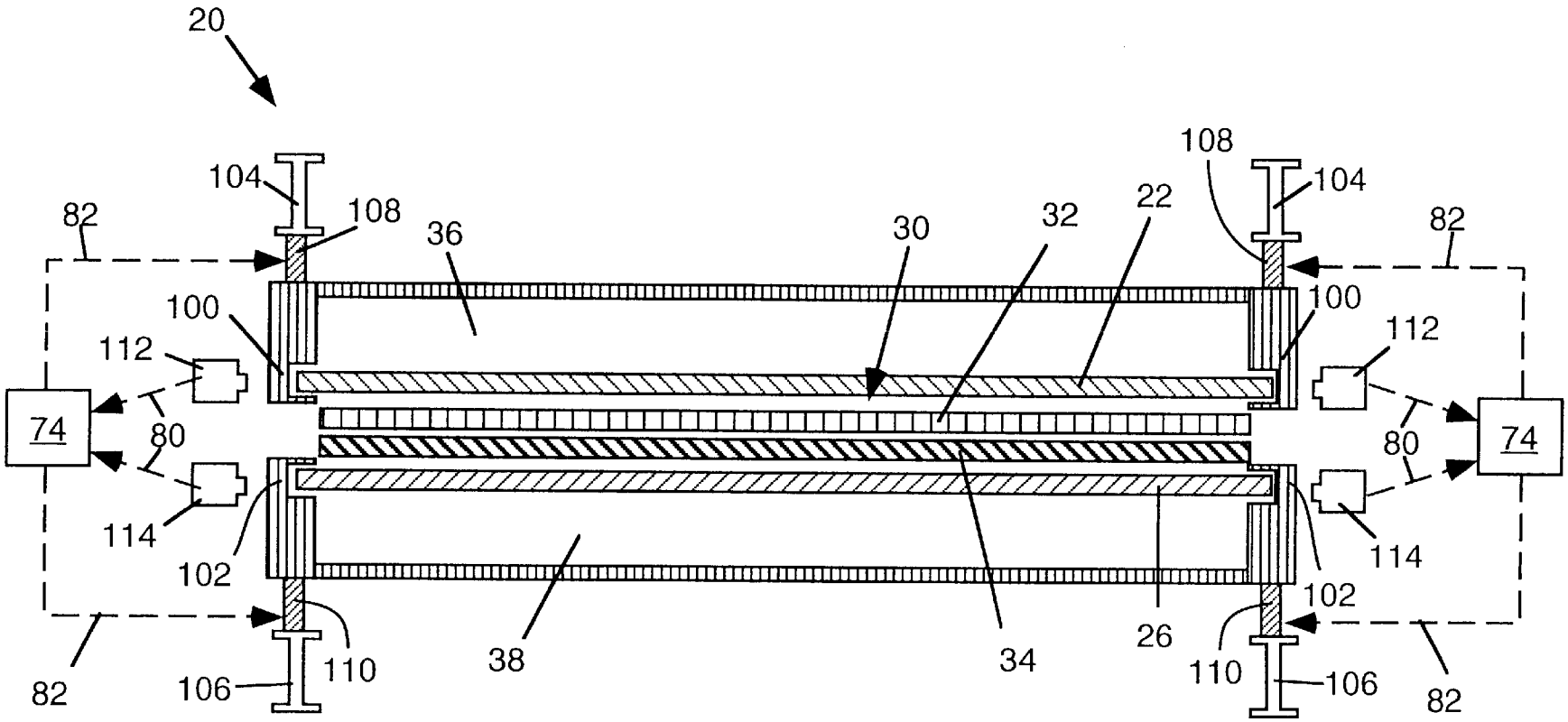
FIG. 5 depicts a cross-directional view of a portion of the drying apparatus of FIG. 4 showing a control system for the positioning of edge seals.

FIG. 5 depicts a cross-section of the drying apparatus 20 taken in the cross-direction of FIG. 4, showing the fibrous web 32 and the drying fabric 34 as they are pressed between two mutually opposed first and second press belts 22 and 26 in the compression zone 30 between a heated upper pressure chamber 36 and a pressurized, cooled opposing device 38. Also depicted are upper edge seals 100 and lower edge seals 102 for preventing pressure leaks at the sides of the first and second press belts 22 and 26. The upper and lower edge seals 100 and 102 respectively are connected to the upper and lower support beams 104 and 106 which extend in the machine direction (normal to the plane of the page in FIG. 5) by means of adjustable upper and lower mounts 108 and 110. The relative position of the upper and lower edge seals 100 and 102, respectively, is sensed by upper and lower proximity sensors 112 and 114, which also extend in the machine direction to permit measurement of deflection of the upper and lower edge seals 100 and 102 in the machine direction. The deflections of the upper and lower edge seals 100 and 102 in the machine direction, due to deflections of the upper and lower support beams 104 and 106 or of the adjustable upper and lower mounts 108 and 110 will generally cause nonuniformity in the cross-direction of the position or flatness of the first and second press belts 22 and 26, and can lead to nonuniformity in the cross-direction in the heating and compression of the fibrous web 32, thus leading to nonuniform web properties. When undesirable deflection of the upper and lower edge seals 100 and 102 occurs, the adjustable upper and lower mounts 108 and 110 can be adjusted responsive to a signal from the upper and lower proximity sensors 112 and 114 (or other sensors for measuring the position of upper and lower edge seals 100 and 102 or for measuring leakage along the upper and lower edge seals 100 and 102) to bring the performance and position of the drying apparatus 20 within desired operating parameters. The data pathways 80 and 82 conduct a signal from the upper and lower proximity detectors 112 and 114 or other position-sensitive measurement devices. The control system 74 compares the signals to each other and to standard values, then sends a signal over the data pathway 82 to the adjustable upper and lower mounts 108 and 110 to cause adjustment of the upper and lower mounts 108 and 110 to occur to reduce the deviation detected by the control system 74.

For example, if an upper edge seal 100 on one side of the drying apparatus 20 has deflected from its desired position due, perhaps, to temperature gradients in the upper support beam 104, a signal from the upper proximity detector 112 on the appropriate side will generate a signal along data path 80 responsive to that deflection. The control system 74 on that side of the drying apparatus 20 will then send a signal to the adjustable upper mounts 108 on the appropriate side to counter the effect of the deflected upper support beam 104 and bring the upper edge seal 100 back within the desired position for effective operation. Without this correction means, the first press belt 22 may deflect away from the desired plane at the side of the drying apparatus 20 in question, resulting in a problems with subsequent creping or with a fibrous web 32 exposed to cross-direction variability in applied pressure due to differences in the gap width between the opposed first and second press belts 22 and 26 across the machine direction.

The adjustable upper and lower mounts 108 and 110 may comprise pneumatic, hydraulic, electronic, and mechanical means such as spaced apart pistons, piezoelectric force generators, thermal means to create force by expansion or contraction of temperature sensitive materials (including bimetallic systems that deflect in controlled ways in response to applied temperature), mechanical gears that rotate to control position, air bags, screw and jack assemblies, adjustable weights applied to the beams, and the like known in the art.

Figure 6:
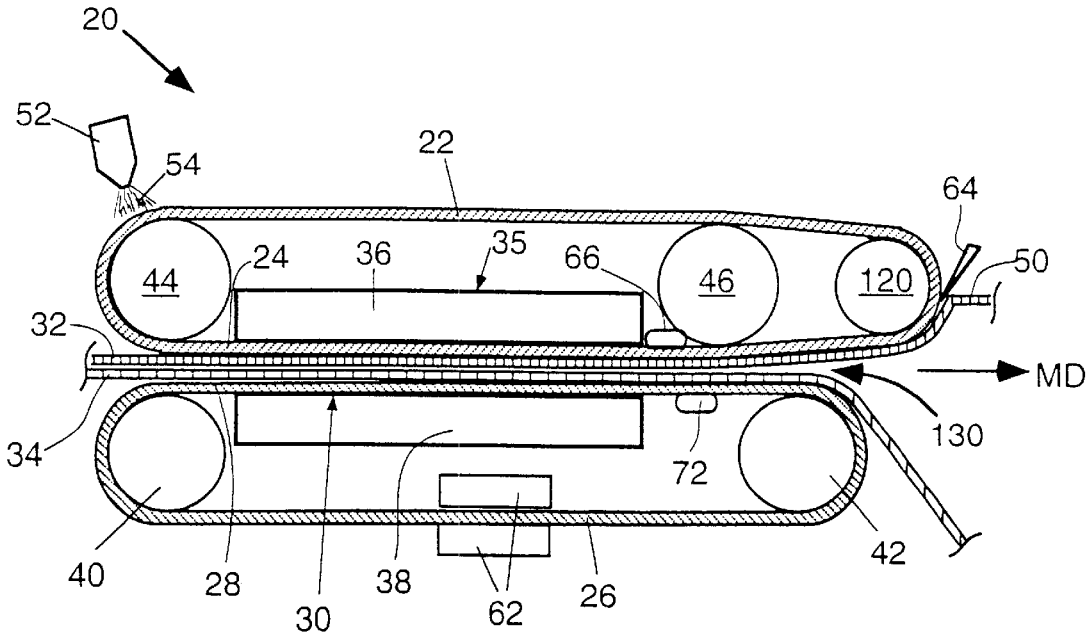
FIG. 6 depicts an alternative embodiment of the present invention offering improved control of depressurization of a web leaving the drying apparatus.

FIG. 6 depicts a version of the drying apparatus 20 in which the first press belt 22 passes over three upper turning rolls 44, 46, and 120, the additional upper third turning roll 120 being adjustable in position to guide the first press belt 22 and to control the depressurization of the fibrous web 32 in a decompression zone 130, where the applied pressure on the fibrous web 32 can be ramped down instead of being suddenly released. In this manner, delamination and other harmful effects can be mitigated by control over the depressurizing state.

Ramping down of the external pressure is a function of the position of the adjustable upper third turning roll 120. If the adjustable upper third turning roll 120 is raised several inches or more above the plane of the fibrous web 32 in the compression zone 30, depressurization after passing beyond the second upper turning roll 46 may be rapid because the fibrous web 32 may rapidly be freed from constraints. By moving the adjustable upper third turning roll 120 further downward, restraint begins to be applied in the decompression zone 130 between the upper second turning roll 46 and the lower second turning roll 42, and the restraint can create a ramp in depressurization. If the adjustable upper third turning roll 120 is lowered still further, higher restraint may exist in the decompression zone 130 and the depressurization may be more rapid, occurring after the lower second turning roll 42. In any case, it is clear that the position of the adjustable upper third turning roll 120 can be optimized to eliminate unwanted decompression effects, such as delamination, and to obtain additional compression, dewatering, or drying.

In the embodiment of FIG. 6, the crepe blade 64 removes the adhered fibrous web 32 from the surface of the first press belt 22 while the fibrous web 32 is over the adjustable upper third turning roll 120.

Figure 7:
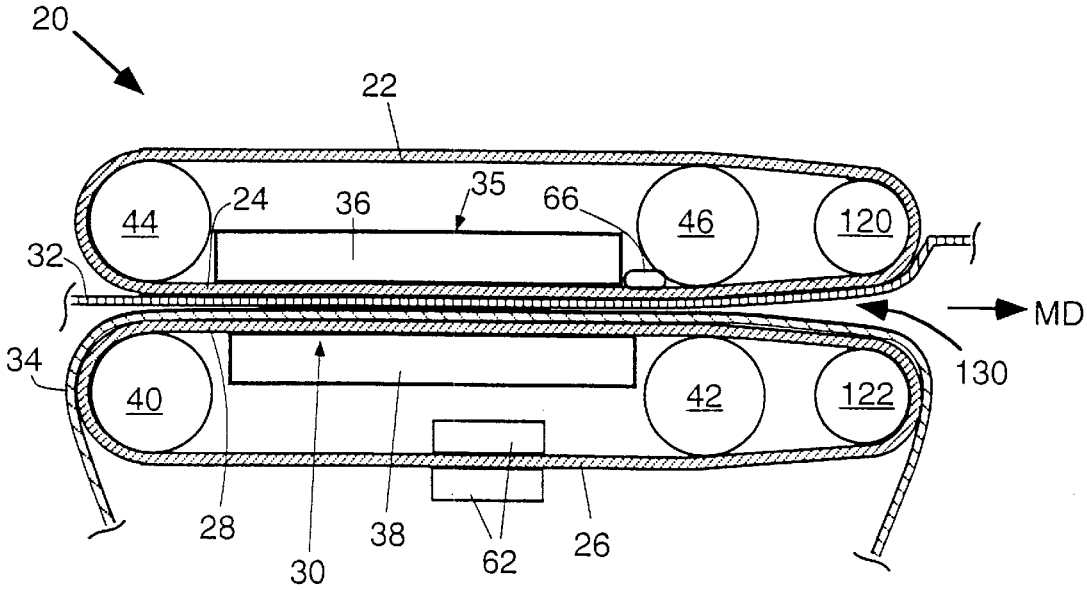
FIG. 7 depicts another alternative embodiment of the present invention offering improved control of depressurization of a web leaving the drying apparatus.

FIG. 7 depicts an embodiment related to that of FIG. 6 but further comprising a lower third turning roll 122 which may be adjustable or fixed, and can be in the plane of the compression zone 30 or rise above or below the plane. At least one of the upper third turning roll 120 and the lower third turning roll 122 should be adjustable for good control of web properties. In particularly, adjustment of the gap between the upper and lower third turning rolls 120 and 122 can be used to help prevent delamination when drying grades susceptible to delamination. In the embodiment of FIG. 7, the crepe blade 64 has been removed and the fibrous web 32 is pulled off. The embodiment shown does not require substantial amounts of adhesive to be applied to the fibrous web 32 or the first press surface 24 of the first press belt 22, for good contact with the heated first press belt 22 is primarily maintained by physical compression rather than chemistry, though adhesives balanced with debonding agents or other release agents can be used to make an uncreped sheet as shown.

The adjustable upper third turning roll 120 of FIGS. 6 and 7 can be controlled not only with respect to elevation, but with tilt in any plane to maintain proper tension and flatness of first press belt 22. The lower third turning roll 122 of FIG. 7 (or any turning roll such as the upper second turning roll 46 of FIG. 1) can likewise be adjustable in terms of tilt in any plane to maintain proper tension and flatness of the first press belt 22 in contact with the turning roll. Mechanical devices adjusting the position of any turning roll or the forces exerted on the turning roll can be responsive to signals from one or more sensors (not shown) measuring parameters associated with belt tension, position, or flatness.

The decompression zone 130 of FIGS. 6 and 7 can be controlled via position of the adjustable upper third turning roll 120 in response to visual or mechanical detection of web delamination, or online measurement of relevant properties, such as ultrasonic measurement of z-direction elastic properties of the fibrous web 32, or image analysis of the fibrous web 32 to detect delaminated zones, and the like.

A related means for prevention of delamination is the use of ramped pressurized zones (not shown) in the compression zone 30 achieved by using a plurality of pressurized zones (not shown) in the upper pressure chamber 36, such that a final pressurized zone has substantially lower pressure than a previous pressurized zone, such as the penultimate pressurized zone. For example, the upper pressure chamber 36 may comprise two zones, a first zone extending up to 90% of the length of the compression zone 30 having a relatively high first pressure, followed by a shorter second zone having a relatively low pressure still greater than atmospheric pressure, such that the fibrous web 32 does not suddenly pass from the first pressure to atmospheric pressure, but is first depressurized in part by a finite dwell time in contact with a lower second pressure. The dwell time of the fibrous web 32 beneath the second zone at the relatively lower second pressure can be about 0.02 seconds or greater, more specifically about 0.1 seconds or greater, such as from about 0.5 seconds to 3 seconds, or from 1 second to 2 seconds, and can be followed by a rapid decompression to atmospheric pressure or a ramped decompression to atmospheric pressure according to the means of FIG. 6 or FIG. 7.

Figure 8:
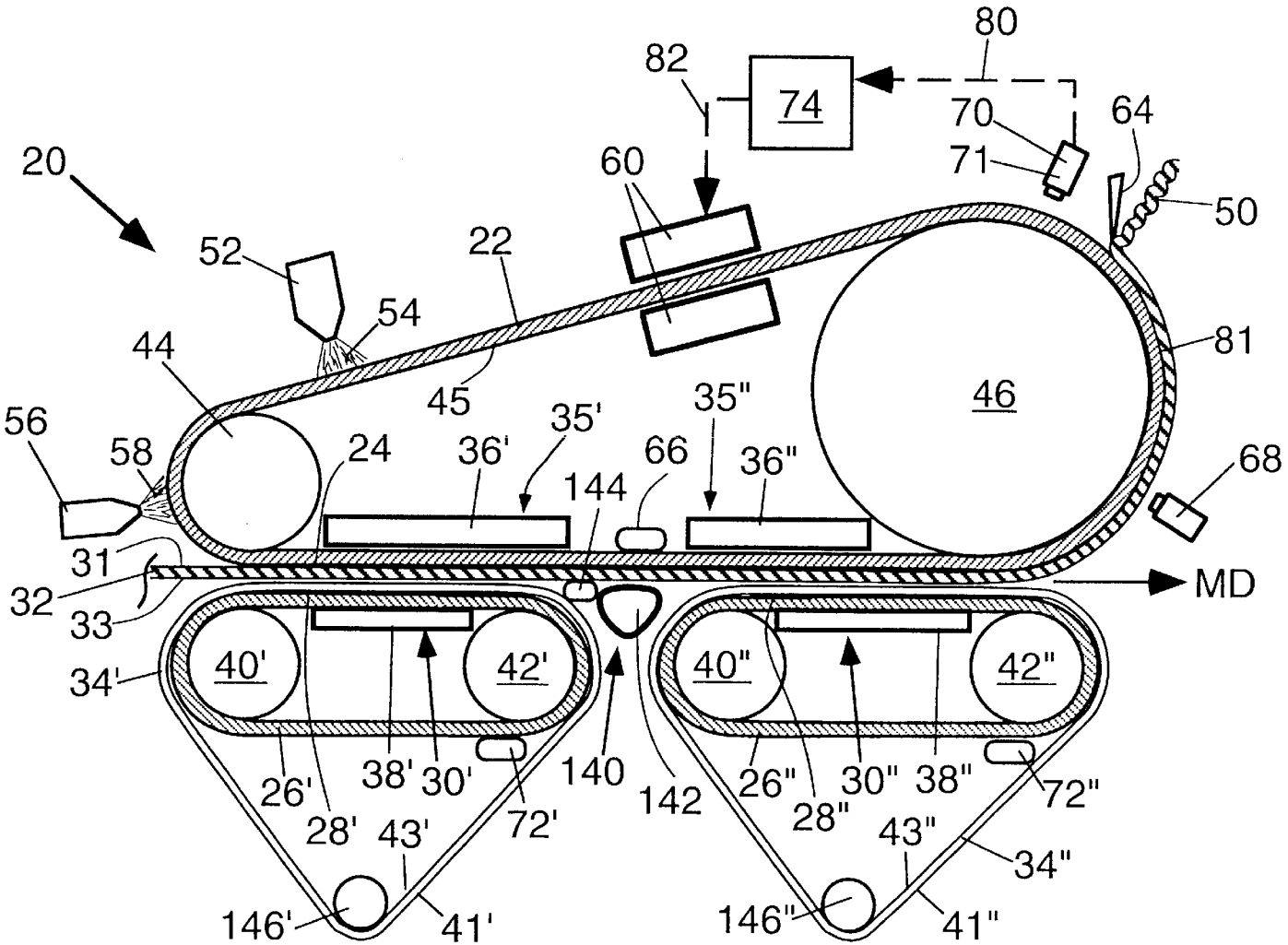
FIG. 8 depicts a version of a drying apparatus in which the lower second press belt and the dryer fabric have each been split into two endless loops.

FIG. 8 depicts another embodiment of a drying apparatus 20 similar to that of FIG. 3, but further comprising separate first and second dryer fabrics 34' and 34", respectively, each having a web-side surface 41' and 41", respectively, and a backside surface 43' and 43", respectively. The first and second dryer fabrics 34' and 34" are associated with the primary and secondary second press belts 26' and 26", respectively. The first dryer fabric 34' resides on the primary second press belt 26', while the second dryer fabric 34" resides on the secondary second press belt 26". The first and second dryer fabrics 34' and 34" form endless loops which are guided by additional fabric turning rolls 146' and 146" (only one roll per fabric is shown, but a plurality of rolls can be used).

The primary and secondary fourth sensors 72' and 72" measure a property of the primary and secondary second press belts 26' and 26", respectively, and generate a signal which is detected by the control system 74 in cooperative relationship with means for maintaining a suitable cross-direction profile of a controlled variable such as temperature, heat flux, applied pressure, roll position, crepe adhesive application, and the like. Such means can include a profitable heating device 60 for heating the first press belt 22. Each of the first and second dryer fabric 34' and 34" can be independently dewatered by vacuum or other water removal units (not shown) and optionally provided with release agents or chemical additives that can transfer to the fibrous web 32. Each of the first and second dryer fabric 34' and 34" independently can be smooth or textured and can differ in porosity. A texture imparted by the first dryer fabric 34' can differ from that imparted by the second dryer fabric 34". For example, the second dryer fabric 34" can substantially less porous or more textured than the first dryer fabric 34'.

The fibrous web 32 is exposed in an open zone 140 between the first and second dryer fabrics 34' and 34". The exposed portion of the fibrous web 32 in the open zone 140 can be treated with a variety of treatments, typically through the action of a web treatment device 142. The web treatment device 142 can be a spray head or print head (e.g., an ink jet head) that uniformly or nonuniformly (e.g., in a repeating pattern or in a cross-direction or machine-direction profile) applies an additive such as a softening agent, a wet strength or dry strength agent, a starch in solution form, a latex, a cationic polymer, an opacifying agent such as a slurry of titanium dioxide, an odor control agent such as baking soda, a silicone compound, a skin wellness agent, an ink or dye, and the like, or a combination thereof. Any tissue or papermaking additive known in the art may be used. The web treatment device 142 can also be a coating head such as a short dwell coater. It can also be a vacuum box for web dewatering, a heating or cooling unit to adjust the temperature of the the fibrous web 32 (e.g., an infrared heater for cross-direction profile control of the temperature of the fibrous web 32), a rotating brush, a textured roll for marking the fibrous web 32, and the like.

The open zone 140 also permits installation of an open zone web sensor 144 which can measure any property of the fibrous web 32, as previously discussed. The property measured by the open zone web sensor 144 can be used as in input to control the temperature or pressure applied in the second compression zone 30", as well as controlling the position of the lower turning rolls 40" and 42" associated with the secondary second press belt 26". Control means for controlling the second compression zone 30" in response to signals from the open zone web sensor 144 or other sensors 66, 68, and 70 are not shown in FIG. 3, but can be any known in the art, including PID controllers, analog or digital controllers, any of those used in distributed control systems or local control systems, and the like.

Examples of control systems and devices for use in papermaking, and applicable to the control systems 74 of the present invention, include the following patents, each of which is herein incorporated by reference in their entireties, to the degree that they are non-contradictory with the present disclosure: U.S. Pat. No. 4,671,173, issued Jun. 9, 1987 to Boissevain; U.S. Pat. No. 5,400,247, issued Mar. 21, 1995 to He; U.S. Pat. No. 3,886,036, issued May 27, 1975 to Dahlin; U.S. Pat. No. 6,080,278, issued Jun. 27, 2000 to Heaven et al.; U.S. Pat. No. 5,045,342, issued Sep. 3, 1991 to Boissevain et al.; U.S. Pat. No. 5,065,673, issued Nov. 19, 1991 to Taylor et al.; and, U.S. Pat. No. 5,928,475, issued Jul. 27, 1999 to Chase et al.

Further examples of control systems 74 for controlling cross-direction profiles of moisture in a web are disclosed in U.S. Pat. No. 5,915,813, issued Jun. 29, 1999 to Joiner; U.S. Pat. No. 5,377,428, issued Jan. 3, 1995 to Clark; and, U.S. Pat. No. 4,823,477 issued Apr. 25, 1989 to Soininen; all of which are herein incorporated by reference in their entireties, to the degree that they are non-contradictory with the present disclosure.

An example of a system for adjusting creping conditions is disclosed in U.S. Pat. No. 5,403,446, issued Apr. 4, 1995 to Trelsmo et al., herein incorporated by reference in its entirety, to the degree that it is non-contradictory with the present disclosure.

Coatings on Metallic Press Belts

Useful techniques for treating a metallic surface with coatings to modify heat transfer to a web are disclosed in U.S. Pat. No. 5,272,821, issued on Dec. 28, 1993 to Orloff and Lenling, herein incorporated by reference. The U.S. Pat. No. 5,272,821 teaches the use of a coating with a thermal conductivity lower than that of steel to control the way in which energy is transferred to a web during impulse drying to reduce delamination. Alternatively, the coating may have a lower thermal diffusivity or a lower K value, defined below. The thermal diffusivity, for example, may be less than about $1\times10^{-6}$ $m^2/s$.

Such a coating may also be useful in reducing blistering and improving uniformity of heat transfer in the present invention. Thus, in one embodiment of the present invention, a coating is provided to the first press surface 24 of the first press belt 22 (a metal band in this embodiment) having a K value of less than about 2000 W $s^{0.5}/m^{2\circ}$ C. and having a low porosity. The K value is related to the density ($\rho$, with units of kilograms per cubic meter, or $kg/m^3$), specific thermal capacity (c, with units of Joules per kilogram per degree Centigrade, or J/kg° C.), and thermal conductivity ($\kappa$, with units of Watts per meter per degree Centigrade, or W/m° C.) of the material in question by the formula $K=(\rho*c*\kappa)^{0.5}$. (I.e., K is the square root of the product of density, specific thermal capacity, and thermal conductivity.) The K value of the surface material can be from about 100 W $s^{0.5}/m^{2\circ}$ C. to about 3000 W $s^{0.5}/m^{2\circ}$ C., and more specifically from about 300 W $s^{0.5}$to about 1800 W $s^{0.5}/m^{2\circ}$ C.

Low porosity is desired on the first press surface 24 of the heated first press belt 22 to prevent absorption of water into the roll surface and to prevent build up of undesired solids in the first press surface 24 of the first press belt 22. In accordance with the present invention, the surface of the first press surface 24 of the first press belt 22 can have a porosity of less than about 10% by volume.

As taught in U.S. Pat. No. 5,272,821, suitable materials having a low K value and low porosity for providing the first press surface 24 of the first press belt 22 of the present invention can be selected from ceramic, polymers, inorganic plastic, glass, composite materials, cermets, diamond (particularly plasma sprayed diamond), boron nitride, silicon nitride, mixtures thereof, and the like known in the art. Other coatings include silicon carbide, fluoropolymers, and the like.

Ceramics are non-metallic inorganic materials containing high proportions of silicon, silicon oxide, silicates, aluminum oxide, magnesium oxide, zirconium oxide, other metal oxides, and mixtures thereof. One group of ceramics is prepared from mixtures of powders of clay, flint, and feldspar. Triaxial ceramics are those prepared from a mixture of the powders of clay, flint, and feldspar with occasional secondary fluxes, such as lime and magnesia. Non-triaxial ceramics contain other components such as talc, bone ash, pyrophyllite, alumina, and mixtures thereof. One suitable type of ceramics are those having a high proportion of alumina or zirconia of above about 30%. Ceramics are formed by preparing a mixture of the ceramic powder with various amounts of water and thereafter forming the ceramic powder by slip casting, jiggering, drain casting, extrusion or pressing. Thereafter, the form is subjected to one or more heat processes to sinter the powder and form the solid ceramic. Ceramics can also be applied to a metallic press belt by any suitable method such as by plasma spraying. The solid ceramic surface typically has a porosity of less than about 10% by volume and may have a porosity of from about 1% to about 7% by volume or less than 3%, including a porosity of substantially zero.

Any suitable polymer may be used for the material of the first and second press surfaces 24 and 28 of the first and second press belts 22 and 26, respectively, of the present invention, provided that the melting temperature is sufficiently high for the specific application. For a heated first press belt 22, a polymer on the first press surface 24 of the first press belt 22 may have a melting point in excess of 200° C. and more specifically in excess of 250° C. Suitable polymers may be selected by reference to a table of structural properties, such as that contained in the Encyclopedia of Modern Plastics, McGraw-Hill, Inc., mid-October, 1988 Issue, Vol. 65, No. 11, pp. 576–619. Representative polymeric products which are suitable for the surface material of the present invention include polyamides, polyacrylonitrile, polyester, fluoroplastics, such as polyetetrafluoroethylene, polychlorotrifluoroethylene and fluorinated ethylene propylene, melamineformaldehyde, phenolics, such as melaminephenolic, polyesters, polyimides, sulfone polymers, and mixtures thereof.

Any common glass, including ceramic glasses (Pyrocerams), may be used for the surface material of the roll of the present invention. Common glass is essentially a sodium calcium silicate in composition. Potassium, barium, zinc, lead, alumina, boron, and mixtures thereof are also often used in various amounts to provide particular properties. The ceramic glasses are produced from irradiated glass by heating the glasses several hundred degrees above the temperature necessary for the development of opacity or color. The ceramic glasses have greater hardness and strength than common glass. The ceramic glass may be applied as discrete particle or fibers joined to the first press surface 24 of the first press belt 22 by a resin or other means, such that flexure of the first press belt 22 does not lead to cracking or failure of the ceramic glass material.

Suitable inorganic plastics may include glass bonded mica, phosphol-asbestos compounds, calcium alumina-silicate compounds, and mixtures thereof.

Cermets are a group of materials consisting of an intimate mixture of ceramic and metallic components. The cermets are fabricated by mixing finely divided components in the form of powders or fibers, compacting the components under pressure and sintering the compact to produce a material with physical properties not found solely in either of the components. The cermets can also be fabricated by internal oxidation of dilute solutions of a base metal and a more noble metal material. When heated under oxidizing conditions, the oxygen diffuses into the alloy to form a base metal oxide in a matrix of the more noble metal material. The ceramic components may be metallic oxides, carbides, borides, silicides, nitrides, and mixtures of these compounds. The metallic components include a wide variety of metals, such as aluminum, beryllium, copper, chromium, iron, silicon, molybdenum, nickel, and mixtures thereof. The cermets can be applied to substrates by plasma spraying.

The cermets are one form of composite material. Other composite materials useful as the surface material on the roll of the present invention are those which are a matrix of a fiber or flake embedded in a suitable resin. The most commonly known form of composite material is fiberglass, which is a matrix of a glass fiber embedded in a polyester or epoxy resin. Other suitable fibers include those of boron, carbon, and mixtures thereof.

One or more layers of coating material, such as a first metallic coating, a second high porosity ceramic coating, and the third low porosity ceramic coating, may be applied by any suitable method known in the art, such as by plasma spraying. Plasma spraying is a well known technique for applying coatings of metals and ceramics. Plasma spraying is described in U.S. Pat. No. 4,626,476 issued on Dec. 2, 1986 to Londry, herein incorporated by reference.

In addition to the coatings with modified thermal properties, the coatings may be applied to control the surface chemistry of the first press belts 22 of the present invention. The application of fluoropolymers, silicones, and fluorosilicones, for example, may be especially useful in controlling the ability of the first press surface 24 of the first press belt 22 to adequately release the fibrous web 32 and prevent build-up of dissolved solids from the fibrous web 32, without jeopardizing heat transfer to the fibrous web 32. A permanent coating may be applied, such as a Teflon™ coating or other fluorinated polymeric coatings, or a film or liquid can be continuously or periodically applied to the fibrous web 32 by a coating technique or spray to control release of dried materials from the first press surface 24 of the first press belt 22.

Other Embodiments

Additional differential velocity transfers may occur outside of the compression zone 30, wherein the fibrous web 32 is transferred from one fabric to a second fabric moving at a different speed (not shown). Differential velocity transfer from one fabric to another can follow the principles taught in any one of the following patents: U.S. Pat. No. 5,667,636, "Method for Making Smooth Uncreped Throughdried Sheets," issued on Sep. 16, 1997 to Engel et al., herein incorporated by reference; U.S. Pat. No. 5,830,321, "Method for Improved Rush Transfer to Produce High Bulk Without Macrofolds," issued on Nov. 3, 1998 to Lindsay and Chen, herein incorporated by reference; U.S. Pat. No. 4,440,597, "Wet-Microcontracted Paper and Concomitant Process," issued on Apr. 3, 1984 to Wells and Hensler; U.S. Pat. No. 4,551,199, "Apparatus and Process for Treating Web Material," issued Nov. 5, 1985 to Weldon; and, U.S. Pat. No. 4,849,054, "High Bulk, Embossed Fiber Sheet Material and Apparatus and Method of Manufacturing the Same," issued on Jul. 18, 1989 to Klowak. When rush transfer is used, the degree of rush transfer may be about 5% or more, more specifically about 15% or more, and most specifically about 30% or more, to impart improved machine direction stretch (e.g., levels of about 10% or greater) to the dried fibrous web 32 and/or to improve the degree of molding or to modify the texture of the fibrous web 32.

The total tensile strength of the fibrous web 32 made according to the present invention can be at least about 300 meters. The fibrous webs 32 made according to the present invention can have a bulk (measured under a compressive load of 0.05 psi) of 5 cubic centimeters per gram (cc/g) or greater, more specifically about 10 cc/g, more specifically from 11 cc/g to 28 cc/g; and most specifically from about 16 cc/g to about 25 cc/g.

Many other treatments and processes known in the art can be applied to the fibrous web 32 of the present invention. For example, elevated portions of a textured fibrous web 32 produced according to the present invention can be selectively treated with a variety of agents. The treated portions may be on either side of the fibrous web 32 and can be the upper surfaces of domes or the backsides of pattern densified regions or elevated regions that are created by an embossing step after drying. Applied agents can be any known additives in the art of tissue making, and can include chemical agents such as starch, surfactants, elastomers, sizing material, waxes, hydrophobic matter, superabsorbent material or superabsorbent precursors, as described in WO 95/13780 by D. Van Phan and P. D. Trokhan, published on May 26, 1995, or according to the various surface treatments disclosed in U.S. Pat. No. 5,431,643, issued to Ouellette et al. on Jul. 11, 1995, and the like to obtain improved physical properties or other properties in the product. The elevated regions or depressed regions so produced can be provided with absorbency aids, as disclosed in U.S. Pat. No. 5,840,403, "Multi-Elevational Tissue Paper Containing Selectively Disposed Chemical Papermaking Additive," issued on Nov. 24, 1998 to Trokhan et al., the parts of which that are non-contradictory with the instant specification being herein incorporated by reference. Elevated portions of the fibrous web 32 can also be provided with hydrophobic material to improve the dry feel of the wetted article against the skin, as disclosed in commonly owned U.S. Pat. No. 5,990,377, "Dual-Zoned Absorbent Webs," issued on Nov. 23, 1999, herein incorporated by reference.

For application of agents to the dry tissue, means such as gravure printing, size press coating of a liquid, and the like can be used. In one embodiment, for example, a latex emulsion or an adhesive material such as polyvinyl alcohol is selectively printed by rotogravure printing or other means onto the most elevated portions of the fibrous web 32. The fibrous web 32 may then be dried, or dried and creped off a Yankee dryer, or joined to another fibrous web 32.

In another embodiment, gravure printing of quaternary ammonium-based debonder agents or other known softening agents can be used at a sufficiently low nip pressure to restrict absorption of the agent so applied to primarily the uppermost portions of the surface of the textured fibrous web 32.

In another embodiment, curtain coating is used to apply a solution to a surface of a fibrous web 32 prior to or after heating between first and second press belts 22 and 26. Curtain coating can be applied with a Hydra-Sizer™ device from GL&V/Black Clawson-Kennedy (Watertown, N.Y.) to apply a starch solution or other additives to the fibrous web 32. If the fibrous web 32 is sufficiently moist, the solution applied by the Hydra-Sizer™ may penetrate the fibrous web 32 for a relatively uniform distribution, whereas if the fibrous web 32 has a solids content above about 10% and a sufficient basis weight, the solution may remain substantially on the surface of the fibrous web 32 for a more one-sided distribution, as described by J. Parisian, "Wet End Application of Starch and Other Additives," *Proceedings of the PAPTAC 87th Annual Meeting,* Montreal, Canada, Jan. 30 to Feb. 1, 2001, vol. A, pp. 23 to 25. The application of starch or other additives with this device may be done uniformly across the cross-direction, or with a profile to compensate for problems along one or both edges of the fibrous web 32 or to achieve other effects. In addition to solutions of starches such as cationic starch of aminofunctional starch-based polymers, wet strength agents, debonders, softeners, and other agents can be added. The applied starch may be used to reduce linting of one or both surfaces of the fibrous web 32, and may be especially useful when a layered tissue structure is used wherein a central layer or layer other than the layer treated with the solution comprises refined fibers or fibers having a strength additive.

In another embodiment, the fibrous web 32 can be pretreated with a heat-sensitive agent prior to drying between first and second press belts 22 and 26. Such agents can be applied to one or both surfaces of the fibrous web 32, uniformly throughout the fibrous web 32, to a subset of the surface of the fibrous web 32 to define a pattern, and the like. Heat-sensitive agents can include polyolefin emulsions, such as PolyCote™ 60 of Hopton Technologies, Inc. (Albany, Oreg.), latex emulsions, wet strength agents, starch solutions or suspensions, lignin and lignin derivatives, thermoplastic solids in a suspension or applied as a powder or in fibrous form (e.g., binder fibers present in the initial fibrous slurry used to make a fibrous web 32 or in an airlaid fibrous web 32 that is dried between first and second press belts 22 and 26).

Any of the above mentioned agents can also be applied substantially uniformly to one or both surfaces of the fibrous web 32.

Skin care agents can likewise be printed or applied to the uppermost portions of the surface of the fibrous web 32, or applied uniformly or in a pattern on the surface of the fibrous web 32. Skin care agents can include emollients, aloe vera, petrolatum, lotions, enzyme inhibitors, and other known therapeutic agents such as, for example, the oxothizolidine-carboxylic acid derivatives of U.S. Pat. No. 6,004,543, issued on Dec. 21, 1999 to Galey et al.; the silicone salicylate esters of U.S. Pat. No. 6,004,542, issued on Dec. 21, 1992 to O'Lenick; or, anti-allergenic compounds, anti-inflammatory compounds, or related topical compounds mentioned in U.S. Pat. No. 5,922,335, issued on Jul. 13, 1999 to Ptchelintsev, herein incorporated by reference, including ascorbyl-phosphoryl-cholesterol compounds.

In other embodiments, the wet or dry fibrous web 32 can also be impregnated with a solution, hot melt, or slurry. One useful method for impregnation of a moist fibrous web 32 is the Hydra-Sizer® system, produced by Black Clawson Corp., Watertown, N.Y.

Skin-care additives, perfumes, menthol, pharmaceuticals and other additives may be applied in microcapsules to the fibrous web 32, and can be selectively applied to elevated portions to permit rupture of the microcapsules during use. Means for preparing microcapsules are disclosed in U.S. Pat. No. 4,683,092, "Capsule Loading Technique," issued on Jul. 28, 1987 to Tsang and U.S. Pat. No. 5,769,832, "Absorbent Article with Odor Masking Agents Released by the Fastening System," issued on Jun. 23, 1998 to Hasse, both of which are herein incorporated by reference. Additives, moisturizers, and liquids, pastes, emulsions, or slurries in general can be provided in continuous lipid enclosures which can break in use to allow the contents to leak or otherwise make contact with the skin of the user. Such technologies are disclosed in U.S. Pat. No. 6,001,381, "Cleaning Articles Comprising a Polarphobic Region and a High Internal Phase Inverse Emulsion," issued on Dec. 14, 1999 to Gordon et al.; U.S. Pat. No. 5,908,707, "Cleaning Articles Comprising a High Internal Phase Inverse Emulsion and a Carrier with Controlled Absorbency," issued on Jun. 1, 1999 to Cabell et al.; U.S. Pat. No. 5,863,663, "WET-LIKE Cleaning Wipes and Like Articles Comprising a Carrier Treated with an Emulsion Having a Continuous Lipid Phase," issued on Jan. 26, 1999 to Mackey et al.; U.S. Pat. No. 5,914,177, "Wipes Having a Substrate with a Discontinuous Pattern of a High Internal Phase Inverse Emulsion Disposed Thereon and Process of Making," issued on Jun. 22, 1999 to Smith, III et al.; and, the like, all of which are herein incorporated by reference.

Any additives, pigments, inks, emollients, pharmaceuticals, and the like described herein or known in the art can be applied to the fibrous web 32 of the present invention, either uniformly or heterogeneously.

In one embodiment, the fibrous web 32 itself comprises multiple layers having different fibers or chemical additives. The fibrous web 32 in layered form can be produced with a stratified headbox or by combining two or more moist fibrous webs 32 from separate headboxes. In one embodiment, an initial pulp suspension is fractionated into two or more fractions differing in fiber properties, such as mean fiber length, percentage of fines, percentage of vessel elements, and the like. Fractionation can be achieved by any means known in the art, including screens, filters, centrifuges, hydrocyclones, application of an ultrasonic fields, electrophoresis, passage of a suspension through spiral tubing or rotating disks, and the like.

The fibrous webs 32 of the present invention can be used in many forms, including multilayered structures, composite assemblies, and the like. The fibrous web 32 may also be used as a basesheet for construction of wet wipes, paper towels, and other articles. For example, the fibrous web 32 may be impregnated with a latex and then creped. Specifically, the fibrous web 32 may be used for single or double print-creping as described in U.S. Pat. No. 3,879,257, "Absorbent Unitary Laminate-Like Fibrous Webs and Method for Producing Them," issued on Apr. 22, 1975 to Gentile et al., herein incorporated by reference. For example, the fibrous web 32 may have dried prior to attachment to the first press belt 22 with the fibrous web 32 having a solids level of at least any of the following: 40%, 50%, 60%, 70%, 80%, 90%, 95%, and 99%, such as from about 45% to about 98%, or from about 65% to about 90%. The fibrous web 32 may have been previously creped one or more times or may be creped one or more times following treatment in the drying apparatus 20. Thus, in addition to the foreshortening means such as the crepe blade 64, there can be a second foreshortening means (not shown) disposed before or after the depicted drying apparatus 20.

The fibrous web 32 may also be treated with wet strength resins on one side prior to entry in the dryer section of the present invention, wherein the wet strength resin assists in creping and provides improved temporary wet strength to the fibrous web 32, as disclosed in U.S. Pat. No. 5,993,602, "Method of Applying Permanent Wet Strength Agents to Impart Temporary Wet Strength in Absorbent Tissue Structures," issued on Nov. 30, 1999 to Smith et al.

Though latex is useful as a binding agent in many applications, for some purposes, the fibrous web 32 can be substantially free of latex (i.e., free of natural latex or free of any latex, whether natural or manmade). Alternatively, the web can comprise less than 5% latex by weight, more specifically less than 2% latex, and most specifically less than 1% latex.

In one embodiment, the fibrous webs 32 of the present invention are laminated with additional plies of tissue or layers of nonwoven materials such as spunbond or meltblown webs, or other synthetic or natural materials. Lamination can be achieved through crimping, perf-embossing, adhesive attachment, etc. The adhesive can comprise natural materials such as starch, gum arabic, and the like, or adhesives containing natural fibers, exemplified by U.S. Pat. No. 5,958,558, "Corrugating Adhesives Employing Tapioca Fiber," issued to J. E. T. Giesfeldt and J. R. Wallace on Sep. 28, 1999.

Laminates formed with the fibrous webs 32 of the present invention can be produced by any method known in the art, including lamination with thermoplastic adhesives to a film as disclosed in U.S. Pat. No. 5,958,178, issued on Sep. 29, 1999 to P. Bartsch and H. J. Mueller.

In another embodiment, the fibrous webs 32 of the present invention are used to produce wet wipes such as premoistened bath tissue.

In one embodiment, the fibrous web 32 of the present invention is an airlaid fibrous web 32 that is subjected to elevated temperature and pressure in the compression zone 30 to cause at least one of the following: drying, densification, curing of binder material such as latex, fusion of thermoplastic material (e.g., bicomponent binder fibers with a fusible sheath around a more thermally stable core) to bind cellulosic fibers together, pattern densification to impart texture, expansion of heat-sensitive expandable materials such as Expancel® microspheres (Expancel, Stockviksverken, Sweden, a division of Akzo Nobel, Netherlands) or thermal decomposing blowing agents to add bulk to the web upon exiting the compression zone, reaction of heat-sensitive chemicals in the fibrous web 32, and the like. Similar objectives can be achieved with a dry or moist wetlaid web, a coform web (a term describing dry laid cellulosic fibers comingled with meltblown polymer), as well as nonwoven webs in general. Though cellulosic webs may be of greatest commerical value, numerous fibrous webs 32 can be treated in the compression zone 30 of the present invention and then removed from the first press surface 24 of the first press belt 22 by creping or other means.

The fibrous webs 32 of the present invention may be subsequently treated in any way known in the art. For example, the fibrous web 32 may be provided with particles or pigments such as superabsorbent particles, mineral fillers, pharmaceutical substances, odor control agents, and the like, by methods such as coating with a slurry, electrostatic adhesion, adhesive attachment, by application of particles to the fibrous web 32 or to the elevated or depressed regions of the fibrous web 32, including application of fine particulates by an ion blast technique as described in WO 00/003092, "Method for Making Paper, Assembly for Implementing the Method and Paper Product Produced by the Method," by V. Nissinen et al., published on Jan. 20, 2000, and the like. The fibrous web 32 may also be calendered, embossed, slit, rewet, moistened for use as a wet wipe, impregnated with thermoplastic material or resins, treated with hydrophobic matter, printed, apertured, perforated, converted to multiply assemblies, or converted to bath tissue, facial tissue, paper towels, wipers, absorbent articles, and the like.

Tissue products of the present invention, whether derived from wetlaid or airlaid fibrous webs 32, can be converted in any known tissue product suitable for any use, such as consumer, medical, or industrial use. Converting can comprise calendering, embossing, slitting, printing, addition of perfume, addition of lotion or emollients or health care additives such as menthol, stacking preferably cut sheets for placement in a carton or production of rolls of finished product, and final packaging of the product, including wrapping with a poly film with suitable graphics printed thereon, or incorporation into other product forms.

In one embodiment, the fibrous web 32 itself comprises multiple layers having different fibers or chemical additives. The fibrous web 32 of the present invention can be produced in layered form, wherein a plurality of furnishes are used to produce an embryonic fibrous web 32. This structure can be achieved by employing a single headbox with two or more strata, or by employing two or more headboxes depositing different furnishes in series on a single forming fabric, or by employing two or more headboxes each depositing a furnish on a separate forming fabric to form an embryonic fibrous web 32 followed by joining ("couching") the embryonic fibrous webs 32 together to form a multi-layered fibrous web 32. The distinct furnishes may be differentiated by at least one of consistency, fiber species (e.g., eucalyptus vs. softwood, or southern pine versus northern pine), fiber length, bleaching method (e.g., peroxide bleaching vs. chlorine dioxide bleaching), pulping method (e.g., kraft versus sulfite pulping, or BCTMP vs. kraft), degree of refining, pH, zeta potential, color, Canadian Standard Freeness (CSF), fines content, size distribution, synthetic fiber content (e.g., one layer having 10% polyolefin fibers or bicomponent fibers of denier less than 6), and the presence of additives such as fillers (e.g., $CaCO_3$, talc, titanium dioxide, silica, activated carbon, zeolites, mica, kaolin, plastic particles such as ground polyethylene, and the like) wet strength agents, starch, dry strength additives, antimicrobial additives, odor control agents, chelating agents, chemical debonders, quaternary ammonia compounds, viscosity modifiers (e.g., CMC, polyethylene oxide, guar gum, xanthan gum, mucilage, okra extract, and the like), silicone compounds, fluorinated polymers, optical brighteners, and the like. For example, U.S. Pat. No. 5,981,044, issued on Nov. 9, 1999 to Phan et al. discloses the use of chemical softeners that are predominantly distributed in the outer layers of the tissue, as can be practiced in the present invention.

Stratified headboxes for producing multilayered fibrous webs 32 are described in U.S. Pat. No. 4,445,974, issued on May 1, 1984, to Stenberg; U.S. Pat. No. 3,923,593, issued on Dec. 2, 1975 to Verseput; U.S. Pat. No. 3,225,074 issued on Dec. 12, 1965 to Salomon et al.; and, U.S. Pat. No. 4,070, 238, issued on Jan. 24, 1978 to Wahren. By way of example, useful headboxes include a four-layer Beloit (Beloit, Wis.)

Concept III headbox or a Voith Sulzer (Ravensburg, Germany) ModuleJet® headbox in multilayer mode.

Principles for stratifying the fibrous web 32 are taught by Kearney and Wells in U.S. Pat. No. 4,225,382, issued on Sep. 30, 1980, which discloses the use of two or more layers to form ply-separable tissue. In one embodiment, first and second layers are provided from slurry streams differing in consistency. In another embodiment, two well-bonded layers are separated by an interior barrier layer to enhance ply separability. Carstens in U.S. Pat. No. 4,300,981, issued on Nov. 17, 1981, discloses a layered web with relatively short fibers on one or more outer surfaces of the tissue web. U.S. Pat. No. 5,932,068, issued on Aug. 3, 1999 issued to Farrington, Jr. et al., herein incorporated by reference, also discloses methods of layering and rush transfer in a through-dried fibrous web 32.

The layered fibrous web 32 may comprise two, three, four, or more layers. A two-layered fibrous web 32 may have splits based on layer basis weights such that the lighter layer has a mass of about 5% or more of the basis weight of the overall web, or about 10% or more, about 20% or more, about 30% or more, about 40% or more, or about 50% or more. Exemplary weight percent splits for a three-layer web include about 20%/20%/60%; about 20%/60%/20%; about 37.5%/25%/37.5%.; about 10%/50%/40%; about 40%/20%/40%; and, approximately equal splits for each layer. In one embodiment, the ratio of the basis weight of an outer layer to an inner layer can be from about 0.1 to about 5; more specifically from about 0.2 to about 3, and, more specifically still from about 0.5 to about 1.5.

Definitions and Test Methods

"Papermaking fibers," as used herein, include all known cellulosic fibers or fiber mixes comprising cellulosic fibers. Fibers suitable for making the webs of this invention comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; woody fibers such as those obtained from deciduous and coniferous trees, including softwood fibers, such as northern and southern softwood kraft fibers; and, hardwood fibers, such as eucalyptus, maple, birch, and aspen. The woody fibers may be prepared in high-yield or low-yield forms and may be pulped in any known method, including kraft, sulfite, high-yield pulping methods, and other known pulping methods. The fibers prepared from organosolv pulping methods may also be used, including the fibers and methods disclosed in U.S. Pat. No. 4,793,898, issued on Dec. 27, 1988 to Laamanen et al.; U.S. Pat. No. 4,594,130, issued on Jun. 10, 1986 to Chang et al.; and, U.S. Pat. No. 3,585,104 issued on June 1971 to Kleinert. Useful fibers may also be produced by anthraquinone pulping, exemplified by U.S. Pat. No. 5,595,628, issued on Jan. 21, 1997 to Gordon et al. Any known bleaching method can be used.

The fibers in the fibrous web 32 may comprise a blend of softwood and hardwood fibers, wherein the blend may have at least any of the following weight percentages of softwood fibers (the balance of the blend being hardwood or some other fiber type): 1%, 5%, 10%, 20%, 30%, 40%, 50%, 60%, 70%, 80%, 90%, 95%, and 99%. The fibrous web 32 may be substantially all softwood. The softwood can be from a bleached kraft pulp such as southern pine or northern pine. Alternatively, the fibrous web 32 can be substantially free of softwood fibers, or can be substantially free of hardwood fibers.

A portion of the fibers, such as up to 50% by dry weight, or from about 5% to about 30% by dry weight, may be synthetic fibers such as rayon, polyolefin fibers, polyester fibers, bicomponent sheath-core fibers, and the like. An exemplary polyethylene fiber is Pulpex®, available from Hercules, Inc. (Wilmington, Del.). Synthetic cellulose fiber types include rayon in all its varieties and other fibers derived from viscose or chemically modified cellulose. Alternatively, the fibrous web 32 may be substantially free of synthetic fibers.

Chemically treated natural cellulosic fibers can be used such as mercerized pulps, chemically stiffened or crosslinked fibers, or sulfonated fibers. Alternatively, the fibrous web 32 may be substantially free of chemically stiffened fibers, crosslinked fibers, and mercerized fibers.

To obtain good mechanical properties during use of the papermaking fibers, it may be desirable that the fibers be relatively undamaged and largely unrefined or only lightly refined. While recycled fibers may be used, virgin fibers are generally useful for their good mechanical properties and their lack of contaminants. Mercerized fibers, regenerated cellulosic fibers, cellulose produced by microbes, rayon, and other cellulosic material or cellulosic derivatives may be used. Suitable papermaking fibers may also include recycled fibers, virgin fibers, or mixes thereof. In certain embodiments capable of high bulk and good compressive properties, the fibers may have a Canadian Standard Freeness of at least about 200, more specifically at least about 300, more specifically still at least about 400, and most specifically at least about 500.

As used herein, "high yield pulp fibers" are those papermaking fibers of pulps produced by pulping processes providing a yield of about 65 percent or greater, more specifically about 75 percent or greater, and still more specifically from about 75 to about 95 percent. Yield is the resulting amount of processed fiber expressed as a percentage of the initial wood mass. High yield pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which contain fibers having high levels of lignin. Characteristic high-yield fibers can have lignin content by mass of about 1% or greater, more specifically about 3% or greater, and still more specifically from about 2% to about 25%. Likewise, high yield fibers can have a kappa number greater than 20, for example. In one embodiment, the high-yield fibers are predominately softwood, such as northern softwood or, more specifically, northern softwood BCTMP.

In one embodiment, the webs of the present invention comprise about 10% or more high yield fibers, such as from about 10% to 50% by weight, or from about 15% to 65%. In another embodiment, the fibrous webs 32 of the present invention contain less than 10% high yield fibers, more specifically less than about 5% high yield fibers, and can be substantially free of high-yield fibers. In another embodiment, the fibrous webs 32 of the present invention can comprise over 0.5% lignin by mass, such as about 1% lignin or greater, more specifically about 2% lignin or greater, and more specifically still about 5% lignin or greater. In other embodiments, the fibrous webs 32 of the present invention comprise less than 0.5% lignin by mass, such as less than 0.3% lignin, or substantially no lignin (e.g., lignin free).

As used herein, the term "cellulosic" includes any material having cellulose as a major constituent, and specifically comprising at least about 50 percent by weight cellulose or a cellulose derivative. Thus, the term includes cotton, typical wood pulps, nonwoody cellulosic fibers, cellulose acetate, cellulose triacetate, rayon, thermomechanical wood pulp, chemical wood pulp, debonded chemical wood pulp, milkweed, or bacterial cellulose.

As used herein, the "wet:dry ratio" is the ratio of the geometric mean wet tensile strength divided by the geometric mean dry tensile strength. Geometric mean tensile strength (GMT) is the square root of the product of the machine direction tensile strength and the cross-machine direction tensile strength of the web. Unless otherwise indicated, the term "tensile strength" means "geometric mean tensile strength." The absorbent webs used in the present invention can have a wet:dry ratio of about 0.1 or greater and specifically about 0.2 or greater, more specifically about 0.3 or greater, and most specifically from about 0.15 to about 0.5. Tensile strength can be measured using an Instron tensile tester using a 3-inch jaw width (sample width), a jaw span of 2 inches (gauge length), and a crosshead speed of 25.4 centimeters per minute after maintaining the sample under TAPPI conditions for 4 hours before testing. The absorbent fibrous webs 32 of the present invention can have a minimum absolute ratio of dry tensile strength to basis weight of about 0.01 gram/gsm, specifically about 0.05 grams/gsm, more specifically about 0.2 grams/gsm, more specifically still about 1 gram/gsm and most specifically from about 2 grams/gsm to about 50 grams/gsm.

As used herein, the term "polymeric web" refers to a porous or nonporous layer primarily composed of polymeric material, and can be a nonwoven web, a plastic film, a polymeric film, an apertured film, or a layer of foam. Polymeric webs can be used as wicking barriers, baffle layers, backsheets, and, if sufficiently liquid pervious, as topsheets of absorbent articles. A polymeric web may consist of about 50 weight percent or more polymeric material, more specifically about 80 weight percent or more polymeric material, and most specifically about 90 weight percent or more polymeric material. Exemplary materials include polyolefins, polyesters, polyvinyl compounds, and polyamides.

As used herein, "bulk" and "density," unless otherwise specified, are based on an oven-dry mass of a sample and a thickness measurement made at a load of 0.34 kPa (0.05 psi) with a 7.62-cm (three-inch) diameter circular platen. For macroscopic thickness measurement to give an overall thickness of the sheet for use in calculating the bulk of the web, the thickness measurement is conducted on a stack of five sheets at a load of 0.05 psi using a three-inch diameter circular platen to apply the load. Samples are measured after conditioned for four hours in a TAPPI-conditioned room. The sheets rest beneath the flat platen and above a flat surface parallel to the platen. The platen is connected to a thickness gauge such as a Mitutoyo digital gauge which senses the displacement of the platen caused by the presence of the sheets. Samples should be essentially flat and uniform under the contacting platen. Bulk is calculated by dividing the thickness of five sheets by the basis weight of the five sheets (conditioned mass of the stack of five sheets divided by the area occupied by the stack, which is the area of a single sheet). Bulk is expressed as volume per unit mass in cc/g and density is the inverse, g/cc.

As used herein, the term "hydrophobic" refers to a material having a contact angle of water in air of at least 90 degrees. In contrast, as used herein, the term "hydrophilic" refers to a material having a contact angle of water in air of less than 90 degrees.

As used herein, the term "surfactant" includes a single surfactant or a mixture of two or more surfactants. If a mixture of two or more surfactants is employed, the surfactants may be selected from the same or different classes, though suitably the surfactants present can be selected or treated such that they are compatible with each other. In general, the surfactant can be any surfactant known to those having ordinary skill in the art, including anionic, cationic, nonionic and amphoteric surfactants. Examples of anionic surfactants include, among others, linear and branched-chain sodium alkylbenzenesulfonates; linear and branched-chain alkyl sulfates; linear and branched-chain alkyl ethoxy sulfates; and, silicone phosphate esters, silicone sulfates, and silicone carboxylates such as those manufactured by Lambent Technologies, located in Norcross, Ga. Cationic surfactants include, by way of illustration, tallow trimethylammonium chloride and, more generally, silicone amides, silicone amido quaternary amines, and silicone imidazoline quaternary amines. Examples of nonionic surfactants, include, again by way of illustration only, alkyl polyethoxylates; polyethoxylated alkylphenols; fatty acid ethanol amides; dimethicone copolyol esters, dimethiconol esters, and dimethicone copolyols such as those manufactured by Lambent Technologies; and, complex polymers of ethylene oxide, propylene oxide, and alcohols. One exemplary class of amphoteric surfactants are the silicone amphoterics manufactured by Lambent Technologies (Norcross, Ga.).

As used herein, "softening agents," sometimes referred to as "debonders," can be used to enhance the softness of the tissue product and such softening agents can be incorporated with the fibers before, during or after disperging. Such softening agents can also be sprayed, printed, or coated onto the web after formation, while wet, or added to the wet end of the tissue machine prior to formation. Suitable softening agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di-hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

As used herein, "wet strength agents" are materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it can be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

There are a number of materials commonly used in the paper industry to impart wet strength to paper and board that are applicable to this invention. These materials are known in the art as "wet strength agents" and are commercially available from a wide variety of sources. Any material that when added to a paper web or sheet results in providing the sheet with a mean wet geometric tensile strength:dry geometric tensile strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after being saturated with water for five minutes. Both classes of material find application in the present invention. The amount of wet strength agent added to the pulp fibers can be at least about 0.1 dry weight percent, more specifically about 0.2 dry weight percent or greater, still more specifically from about 0.1 to about 3 dry weight percent, based on the dry weight of the fibers, and most specifically from about 0.25 to about 2 dry weight percent.

Permanent wet strength agents provide a more or less long-term wet resilience to the structure. In contrast, the temporary wet strength agents would provide structures that had low density and high resilience, but would not provide a structure that had long-term resistance to exposure to water or body fluids. The mechanism by which the wet strength is generated has little influence on the products of this invention as long as the essential property of generating water-resistant bonding at the fiber/fiber bond points is obtained.

Suitable permanent wet strength agents are typically water soluble, cationic oligomeric, or polymeric resins that are capable of either crosslinking with themselves (homocrosslinking) or with the cellulose or other constituent of the wood fiber. The most widely-used materials for this purpose are the class of polymer known as polyamide-polyamine-epichlorohydrin type resins. These materials have been described in patents issued to Keim (U.S. Pat. No. 3,700,623 and U.S. Pat. No. 3,772,076) and are sold by Hercules, Inc., located in Wilmington, Del., as KYMENE 557H polyamine-epichlorohydrin resins. Related materials are marketed by Henkel Chemical Co., located in Charlotte, N.C., and Georgia-Pacific Resins, Inc., located in Atlanta, Ga.

Polyamide-epichlorohydrin resins are also useful as bonding resins in this invention. Materials developed by Monsanto and marketed under the SANTO RES™ label are base-activated polyamide-epichlorohydrin resins that can be used in the present invention. These materials are described in patents issued to Petrovich (U.S. Pat. No. 3,885,158; U.S. Pat. No. 3,899,388; U.S. Pat. No. 4,129,528; and, U.S. Pat. No. 4,147,586) and issued to van Eenam (U.S. Pat. No. 4,222,921). Although they are not as commonly used in consumer products, polyethylenimine resins are also suitable for immobilizing the bond points in the products of this invention. Another class of permanent-type wet strength agents are exemplified by the aminoplast resins obtained by reaction of formaldehyde with melamine or urea.

Suitable temporary wet strength resins include, but are not limited to, those resins that have been developed by American Cyanamid and are marketed under the name PAREZ™ 631 NC wet strength resin (now available from Cytec Industries, located in West Paterson, N.J.). This and similar resins are described in U.S. Pat. No. 3,556,932 issued to Coscia et al. on Jan. 19, 1971 and U.S. Pat. No. 3,556,933 issued to Williams et al. on Jan. 19, 1971. Other temporary wet strength agents that should find application in this invention include modified starches such as those available from National Starch and marketed as CO-BOND™ 1000 modified starch. It is believed that these and related starches are disclosed in U.S. Pat. No. 4,675,394 issued to Solarek et al. on Jun. 23, 1987. Derivatized dialdehyde starches may also provide temporary wet strength. It is also expected that other temporary wet strength materials such as those described in U.S. Pat. No. 4,981,557; U.S. Pat. No. 5,008,344; and, U.S. Pat. No. 5,085,736 issued to Bjorkquist would be of use in the present invention. With respect to the classes and the types of wet strength resins listed, it should be understood that this listing is simply to provide examples and that this is neither meant to exclude other types of wet strength resins, nor is it meant to limit the scope of the present invention.

Although wet strength agents as described above find particular advantage for use in connection with the present invention, other types of bonding agents can also be used to provide the necessary wet resiliency. Such bonding agents can be applied at the wet end of the basesheet manufacturing process or applied by spraying or printing after the basesheet is formed or after it is dried.

The efficacy of cationic wet strength agents can be enhanced by treatment of cellulosic fibers with reactive anionic compounds, according to U.S. Pat. No. 5,935,383, "Method for Improved Wet Strength Paper," issued on Aug. 10, 1999 to Sun and Lindsay, herein incorporated by reference.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

We claim:

1. An apparatus for making a foreshortened cellulosic web, in combination with a dryer fabric, the apparatus comprising:

a) a first press belt having a first press surface, and a second press surface, the second press surface being substantially equidistantly spaced apart from the first press surface in a compression zone;

b) a pressing means for pressing the first and second press surfaces towards each other in the compression zone to compress a cellulosic web residing on the dryer fabric, wherein the first press surface contacts the cellulosic web;

c) a means for creating a temperature differential between the first press surface and the second press surface to move water from the cellulosic web into the dryer fabric;

d) a transporting means for moving the cellulosic web in the machine direction at a first velocity;

e) a foreshortening means for foreshortening the cellulosic web after the web has passed through the compression zone;

f) sensor means for determining the cross-directional variability of a property of at least one of the cellulosic web, the first press belt, the first press surface, and the second press surface, wherein the sensor means generates an output signal based on the cross-directional variability of the property; and, g) control means for decreasing the cross-directional variability of the property responsive to the signal from the sensor means.

2. The apparatus of claim 1, wherein the property is selected from temperature, flatness, surface topography, local tension, and elastic modulus of the cellulosic web.

3. The apparatus of claim 1, wherein the property is a temperature-related property and wherein the control means comprises means for adjusting the temperature profile in the cross-direction of at least one of the first press belt and the second press surface.

4. The apparatus of claim 1, wherein the property is selected from temperature of the first press belt, flatness of the first press belt or the web prior to foreshortening, surface topography the first press belt or the web prior to foreshortening, and local tension in the first press belt.

5. The apparatus of claim 1, wherein the control means comprises at least one of a heating system and a cooling system, adapted to provide heating or cooling, respectively, wherein heating or cooling can be applied variably in the cross direction in response to the signal from the sensor means.

6. The apparatus of claim 5, wherein the control means comprises the heating system comprising at least one an induction heater, a gas-fired heater, an infrared heater, and a heater element comprising thermal fluids.

7. The apparatus of claim 1, wherein the control means comprises a first press belt heating means that is profitable in the cross-direction.

8. The apparatus of claim 1, wherein the control means comprises a second press surface cooling means that is profitable in the cross-direction.

9. The apparatus of claim 1, further comprising a second press belt which comprises the second press surface.

10. The apparatus of claim 1, wherein the first press belt is a metal belt.

11. The apparatus of claim 10, wherein the metal belt comprises a durable coating having a thermal property substantially different than that of the metal of the metal belt.

12. The apparatus of claim 11, wherein the thermal property is selected from thermal conductivity, thermal diffusivity, and $\sqrt{\rho\kappa c_p}$, where $\rho$ is density, $\kappa$ is thermal conductivity, and $c_p$ is specific thermal capacity.

13. The apparatus of claim 12, wherein the thermal property is the square root of the product of density, thermal conductivity, and specific thermal capacity.

14. The apparatus of claim 11, wherein the durable coating has a thickness of about 10 microns or greater.

15. The apparatus of claim 11, wherein the durable coating has a thickness of about 50 microns or greater.

16. The apparatus of claim 11, wherein the durable coating has a thickness of about 100 microns or greater.

17. The apparatus of claim 11, wherein the basis weight of the applied durable coating is at least about 10 gsm or greater.

18. The apparatus of claim 11, wherein the basis weight of the applied durable coating is at least about 20 gsm or greater.

19. The apparatus of claim 11, wherein the basis weight of the applied durable coating is at least about 30 gsm or greater.

20. The apparatus of claim 11, wherein the basis weight of the applied durable coating is at least about 50 gsm or greater.

21. The apparatus of claim 11, wherein the basis weight of the applied durable coating is at least about 100 gsm or greater.

22. The apparatus of claim 1 or 10, wherein the first press belt comprises a base material having a surface and plasma-sprayed coating on the surface of the base material.

23. The apparatus of claim 1, wherein the first press belt comprises a base material having a surface and polymeric coating on the surface of the base material.

24. The apparatus of claim 23, wherein the polymeric coating has a lower surface energy than the base material.

25. The apparatus of claim 1, wherein the first press surface is patterned to emboss the cellulosic web when the cellulosic web is being pressed between the first and second press surfaces.

26. The apparatus of claim 1, wherein the compression zone is linear.

27. The apparatus of claim 1, wherein the compression zone is curved.

28. The apparatus of claim 1, wherein the compression zone has a length of about 50 centimeters or greater.

29. The apparatus of claim 1, wherein the pressing means includes a pressure chamber and an opposing device.

30. The apparatus of claim 29, wherein the pressure chamber is heated.

31. The apparatus of claim 30, wherein the pressure chamber is heated with steam and the second press surface is cooled with liquid water.

32. The apparatus of claim 30, wherein the pressure chamber is pressurized with steam.

33. The apparatus of claim 1, further comprising a carrier fabric for carrying the cellulosic web toward a dryer section, and a press roll around which the carrier fabric turns, wherein the press roll is adapted to press the cellulosic web against the first press belt to transfer the cellulosic web to the first press belt.

34. The apparatus of claim 33, wherein the press roll applies a load of 30 pounds per linear inch or greater when pressing the cellulosic web against the first press belt.

35. The apparatus of claim 33, wherein the carrier fabric is a papermaking felt.

36. The apparatus of claim 33, wherein the carrier fabric is an imprinting fabric comprising deflection conduits.

37. The dryer section of claim 33 further comprising edge seals extending in the machine direction for the first press belt, wherein the sensor means comprises detectors responsive to the position of the edge seals.

38. The apparatus of claim 1, wherein the foreshortening means comprises a crepe blade.

39. The apparatus of claim 1 or 38, wherein the foreshortening means comprises an air jet.

40. The apparatus of claim 1, further comprising a carrier fabric traveling at a lower velocity than the first press belt, and wherein the foreshortening means comprises a transfer nip wherein the cellulosic web is transferred from the first press belt to the carrier fabric.

41. The apparatus of claim 1, wherein the foreshortening means foreshortens the cellulosic web after it has been removed from the first press surface of the first press belt.

42. The apparatus of claim 1, wherein the foreshortening means foreshortens the cellulosic web while the cellulosic web is in contact with the first press belt.

43. The apparatus of claim 1, further comprising adhesive application means to join the cellulosic web to the first press belt.

44. The dryer section of claim 1, wherein the second press surface is joined to the dryer fabric.

45. The dryer section of claim 1, further comprising an adjustable decompression zone operatively associated with an adjustable turning roll.

46. A dryer section for a paper machine having a front end, a rear end, a machine direction, a cross direction, and a z-direction substantially normal to both the machine direction and cross-direction, comprising:

a) an endless dryer fabric;

b) first and second press belts having opposing first and second press surfaces, respectively, through which the dryer fabric passes, adapted such that a web in contact with the dryer fabric and the first press belt can pass between the first and second press belts;

c) a pressing means for driving first and second press surfaces together to pressurize the web;

d) a temperature differential means for maintaining the first press surface at a higher temperature than the second press surface, whereby water removal from the web is enhanced by the resulting temperature differential;

e) a foreshortening means for foreshortening the web after the web is released from the pressure between the first and second press surfaces;

f) a sensor means for determining the cross-directional variability in a property of at least one the first press belt, the second press belt, the web, or a combination thereof, and generating a corresponding signal; and, g) a control means responsive to the signal of the sensor means for decreasing the cross-directional variability of the property responsive to the sensor means.

47. The dryer section of claim 46, further comprising a pair of turning rolls cooperatively associated with the first press belt, wherein the control means comprises a position adjustor for one or more of the turning rolls.

48. The dryer section of claim 46, wherein the control means comprises a temperature profiling system for adjusting the cross-directional temperature profile of the first press belt.

49. The dryer section of claim 46, 47, or 48, wherein the property is selected from the temperature of the first press belt or the flatness of the first press belt.

50. The dryer section of claim 46, wherein the foreshortening means comprises a crepe blade acting against the first press belt.

51. The dryer section of claim 46, wherein the first press belt is a metallic band having a paper-facing side wherein the paper-facing side is coated with a durable coating having at least one of a lower thermal conductivity and a lower surface energy than the metal in the metallic band of the first press belt.

52. The dryer section of claim 46, wherein the second press belt is joined to the dryer fabric.

53. The dryer section of claim 46, wherein at least one of the dryer fabric and second press belt comprises a capillary dewatering belt.

54. The dryer section of claim 46, wherein the control means comprise a heating device capable of applying energy to the first press belt variably in the cross-direction.

55. The dryer section of claim 46, wherein the control means comprise a cooling device capable of cooling the first press belt variably in the cross-direction.

56. An apparatus for making a foreshortened cellulosic web, comprising:

a) an impermeable first press belt having a first press surface, and a unitary second press belt operatively associated with a dryer fabric and having a second press surface and a backside surface opposing the second press surface, the second press surface being provided with pores for receiving condensate;

b) a press means for pressing the first and second press surfaces towards each other in a compression zone to compress a cellulosic web, wherein the first press surface contacts the cellulosic web;

c) a means for creating a temperature differential between the first press surface and the second press surface to move water from the cellulosic web into the dryer fabric;

d) a transporting means for moving the cellulosic web in the machine direction at a first velocity; and, e) a foreshortening means for foreshortening the cellulosic web after the web has passed through the compression zone, wherein the unitary second press belt is porous throughout its thickness.

57. The apparatus of claim 56, wherein the unitary second press belt is impervious.

58. The apparatus of claim 56, wherein at least the second press surface of the unitary second press belt comprises a polymer.

59. The apparatus of claim 56, further comprising a water removal means to remove condensate from the unitary second press belt.

60. The apparatus of claim 59, wherein the water removal means is applied to the back side of the unitary second press belt.

61. The apparatus of claim 59, wherein the water removal means is applied to the web-contacting side of the unitary second press belt.

62. The apparatus of claim 56, wherein the unitary second press belt comprises a polymeric, foraminous fabric joined to a metallic band.

63. The apparatus of claim 56, wherein the unitary second press belt comprises a porous metallic surface.

64. The apparatus of claim 56, further comprising an adhesive applicator means for applying an adhesive to at least the first press surface of the first press belt prior to contacting the cellulosic web.

65. The method of claim 1 or 56, further comprising a second foreshortening means, whereby the web is foreshortened at least twice.

66. An apparatus for making a foreshortened cellulosic web, comprising:

a) an impermeable first press belt having a first press surface and a unitary second press belt operatively associated with a dryer fabric and having a second press surface and a backside surface opposing the second press surface, the second press surface begin provided with pores for receiving condensate;

b) a press means for pressing the first and second press surfaces towards each other in a compression zone to compress a cellulosic web, wherein the first press surface contacts the cellulosic web;

c) a means for creating a temperature differential between the first press surface and the second press surface to move water from the cellulosic web into the dryer fabric;

d) a transporting means for moving the cellulosic web in the machine direction at a first velocity;

e) a foreshortening means for foreshortening the cellulosic web after the web has passed through the compression zone;

f) a sensor means for determining the cross-directional variability of a property of at least one of the cellulosic web, the first press belt, the first press surface, the second press belt, and the second press surface, wherein the sensor means generates an output signal based on the cross-directional variability of the property; and, g) a control means for decreasing the cross-directional variability of the property responsive to the signal from the sensor means.

* * * * *